US006900419B2

(12) United States Patent
Takagi et al.

(10) Patent No.: US 6,900,419 B2
(45) Date of Patent: May 31, 2005

(54) FIXING APPARATUS

(75) Inventors: Osamu Takagi, Tokyo (JP); Satoshi Kinouchi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/455,419

(22) Filed: Jun. 6, 2003

(65) Prior Publication Data

US 2004/0141038 A1 Jul. 22, 2004

(30) Foreign Application Priority Data

Jun. 6, 2002 (JP) ..... 2002-166050

(51) Int. Cl.[7] ..... H05B 6/14
(52) U.S. Cl. ..... 219/619; 399/329; 399/69
(58) Field of Search ..... 219/619, 671, 219/216, 469; 399/69, 33, 330, 335, 338, 67, 324, 328, 329

(56) References Cited

U.S. PATENT DOCUMENTS

| | | | | |
|---|---|---|---|---|
| 5,752,150 A | * | 5/1998 | Kato et al. | 399/330 |
| 6,026,273 A | | 2/2000 | Kinouchi et al. | |
| 6,049,691 A | * | 4/2000 | Abe et al. | 399/330 |
| 6,078,781 A | | 6/2000 | Takagi et al. | |
| 6,087,641 A | | 7/2000 | Kinouchi et al. | |
| 6,097,926 A | | 8/2000 | Takagi et al. | |
| 6,137,985 A | | 10/2000 | Kinouchi et al. | |
| 6,154,629 A | * | 11/2000 | Kinouchi et al. | 399/329 |
| 6,292,647 B1 | * | 9/2001 | Ishida | 399/330 |
| 6,337,969 B1 | | 1/2002 | Takagi et al. | |
| 6,415,128 B1 | | 7/2002 | Takagi et al. | |
| 6,438,335 B1 | | 8/2002 | Kinouchi et al. | |
| 6,577,839 B2 | * | 6/2003 | Samei | 399/328 |
| 6,643,476 B1 | | 11/2003 | Kinouchi et al. | |
| 6,643,491 B2 | | 11/2003 | Kinouchi et al. | |
| 6,724,999 B2 | | 4/2004 | Kikuchi et al. | |
| 6,725,000 B2 | | 4/2004 | Takagi et al. | |
| 6,753,515 B2 | * | 6/2004 | Miyahara et al. | 219/619 |
| 6,763,206 B2 | | 7/2004 | Kinouchi et al. | |
| 2002/0125244 A1 | * | 9/2002 | Yokozeki et al. | 219/619 |
| 2003/0219271 A1 | | 11/2003 | Kinouchi et al. | |

OTHER PUBLICATIONS

U.S. Appl. No. 10/390,645, filed Mar. 19, 2003, Takagi et al.
U.S. Appl. No. 10/378,859, filed Mar. 5, 2003, Sone et al.
U.S. Appl. No. 10/378,865, filed Mar. 5, 2003, Tsueda et al.
U.S. Appl. No. 10/382,846, filed Mar. 7, 2003, Kinouchi et al.
U.S. Appl. No. 10/387,413, filed Mar. 14, 2003, Kinouchi et al.

* cited by examiner

*Primary Examiner*—Quang T. Van
(74) *Attorney, Agent, or Firm*—Foley & Lardner LLP

(57) ABSTRACT

A fixing apparatus an aspect of the present invention includes, a heating object which generates the heat by a magnetic flux produced from a coil which generates a predetermined magnetic flux by electromagnetic induction in accordance with a frequency of an input current, and a pressurization mechanism which can provide a predetermined pressure to the heating object, and a coil of the heating object is formed of a litz wire obtained by twisting the number of conductors having a small cross section which are not affected by the skin effect caused due to the frequency of the input current, the number of which allows passage of a quantity of current to be inputted.

11 Claims, 14 Drawing Sheets

FIXING APPARATUS

CROSS-REFERENCE TO RELATED APPLICATIONS

This application is based upon and claims the benefit of priority from the prior Japanese Patent Application No. 2002-166050, filed Jun. 6, 2002, the entire contents of which are incorporated herein by reference.

BACKGROUND OF THE INVENTION

1. Field of the Invention

The present invention relates to a heating apparatus utilizing induction heating, and more particularly to a fixing apparatus which fixes a toner which can be utilized in an electrophotographic type copying apparatus or a printer apparatus using a toner having the thermofusion property as a visualization agent.

2. Description of the Related Art

A fixing apparatus incorporated in a copying apparatus using an electrophotographic process heats and melts a toner formed on a transfer medium, and fixes the toner on the transfer medium.

As a method of heating the toner which can be utilized in the fixing apparatus, a method of using the heat radiated from a filament lamp, a flash fixing method using a flash lamp, or the like is well known. It is to be noted that a fixing apparatus using an induction heating device which utilizes heat generation of a metal caused due to electromagnetic induction has also come into practical use in recent years.

Further, in many cases, there are used a heat (fixing) roller having a heater set therein and a pressure roller which is pressed against the heat roller at one point on the outer periphery of the heat roller by a predetermined pressure. According to this structure, it is well known that the heat of the heat roller can be efficiently supplied to the toner and also that a pressure used to fix the melted toner to the transfer medium can be readily supplied to the transfer medium and the toner.

Nowadays, the induction heating type heating apparatus is extensively utilized since its time required for increasing a temperature of the surface of the heat roller is shorter than that of a heating apparatus which is of a type using a filament lamp as a heat source.

Meanwhile, in many fixing apparatuses each using the induction heating type heating apparatus, a general-purpose circuit called, e.g., the semi E class is utilized for the purpose of lowering a cost of a drive circuit which supplies a predetermined power to an induction coil which generates an eddy current in the heat roller in order to increase a temperature of the heat roller.

In case of using the semi E class general-purpose circuit, however, a current of several-ten ampere flows through the induction coil due to an impedance of an inverter circuit including the induction coil. This has a problem of an increase in a cross section of an electric wire used in the induction coil.

On the other hand, as the electric wire used in the induction coil, e.g., an expensive litz wire must be used in order to avoid the influence of the skin effect which becomes prominent when a frequency of the current inputted to the coil is changed to a high frequency.

Furthermore, since a size of the induction coil is increased owing to a fact that an electric wire with a large cross section must be used, an outside diameter of the heat roller is disadvantageously increased when the induction coil is arranged inside the heat roller in order to increase the utilization efficiency of a magnetic flux generated from the induction coil.

It is to be noted that there may occur a problem of generation of the flicker that a light quantity of the light radiated from an illumination equipment arranged in a surrounding area, especially a discharge lamp such as a fluorescent lamp due to an intensity of the current flowing through the inverter circuit, i.e., the induction coil when the current is supplied to the induction coil from a non-energization state or when the current supplied to the induction coil is interrupted.

BRIEF SUMMARY OF THE INVENTION

It is an object of an aspect of the present invention to suppress changes in the intensity of a current flowing through a circuit, i.e., voltage fluctuations in a heating apparatus utilizing electromagnetic induction, and reduce dimensions of the heating apparatus, a fixing apparatus in which the heating apparatus is incorporated and a temperature increasing mechanism.

A first aspect of the present invention is directed to a fixing apparatus comprising:

a heat-producing member which has a hollow cylindrical shape or an endless belt-like shape, is formed in such a manner that a peripheral surface thereof can move at a predetermined speed if it has the cylindrical shape and a belt surface thereof can move at a predetermined speed if it has the belt-like shape, and can supply a predetermined heat to a material having a thermofusion property and a base material holding the material having the thermofusion property;

a pressure provision mechanism which has a cylindrical shape, is arranged so as to be capable of providing a predetermined pressure to the heat-producing member with the material having the thermofusion property and the base material being interposed between itself and the heat-producing member, and has a peripheral surface which can move in accordance with the peripheral surface and the belt surface of the heat-producing member when the peripheral surface and the belt surface of the heat-producing member are moved at a predetermined speed; and a heating mechanism which is arranged in a predetermined positional relationship with respect to the heat-producing member, and can generate a predetermined power or a magnetic flux required to cause the heat-producing member to output a predetermined quantity of heat when a current having a frequency of not less than 1 MHz is supplied.

A second aspect of the present invention is directed to a heating apparatus comprising: a heat-producing member which generates heat by a magnetic flux produced around a coil which generates a predetermined magnetic flux and a voltage by electromagnetic induction in accordance with a frequency of a current supplied thereto; and a pressurization mechanism which can provide a predetermined pressure to the heat-producing member, wherein a coil of the heat-producing member is formed of a litz wire obtained by twisting the number of conductors having a small cross section which are not affected by the skin effect caused due to a frequency of a power inputted thereto, the number of which allows passage of a quantity of current to be inputted.

A third aspect of the present invention is directed to a fixing apparatus comprising:

a heat-producing member which has a hollow cylindrical shape or an endless belt-like shape, is formed in such a manner that a peripheral surface thereof can move at a predetermined speed if it has the cylindrical shape and a belt surface thereof can move at a predetermined speed if it has the belt-like shape, and can supply a predetermined heat to a material having a thermofusion property and a base material holding the material having the thermofusion property;

a pressure provision mechanism which is arranged so as to be capable of providing a predetermined pressure to the heat-producing member with the material having the thermofusion property and the base material being interposed between itself and the heat-producing member, and can move in accordance with the peripheral surface and the belt surface of the heat-producing member when the peripheral surface and the belt surface of the heat-producing member are moved at a predetermined speed;

a heating mechanism which is arranged in a predetermined positional relationship with respect to the heat-producing member, and can generate a predetermined power or a magnetic flux required to cause the heat-producing member to output a predetermined quantity of heat when a current having a first frequency, a second frequency or a third frequency which is different from the first and second frequencies is supplied;

a temperature detection mechanism which detects a temperature at a predetermined position of the heat-producing member; and a setting mechanism which sets a frequency of the power of the magnetic flux outputted from the heating mechanism to any of the first to third frequencies based on the temperature at the predetermined position of the heat-producing member detected by the temperature detection mechanism.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Preferred embodiments according to the present invention will now be described in detail hereinafter with reference to the accompanying drawings.

Figure 1:
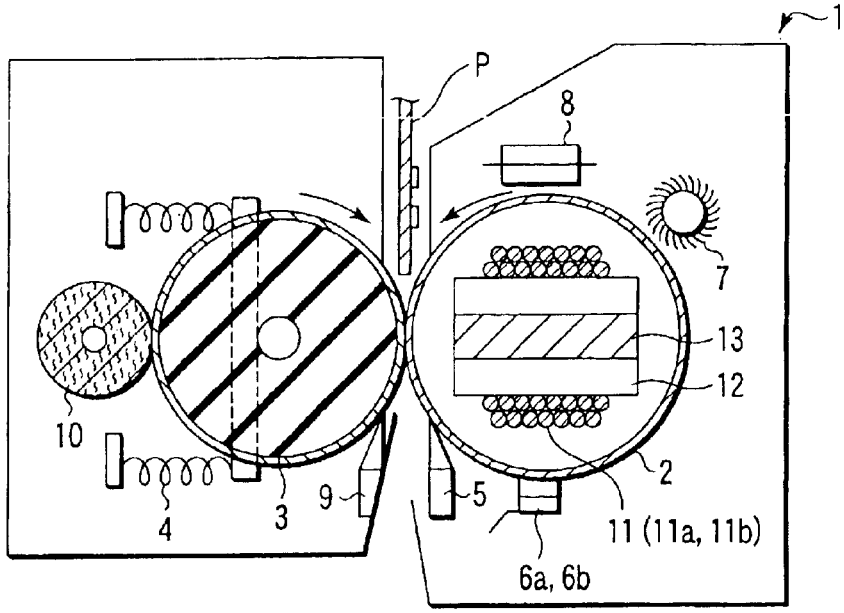
FIG. 1 is a schematic view for illustrating an example of a fixing apparatus to which an embodiment according to the present invention is applied.
Figure 2:
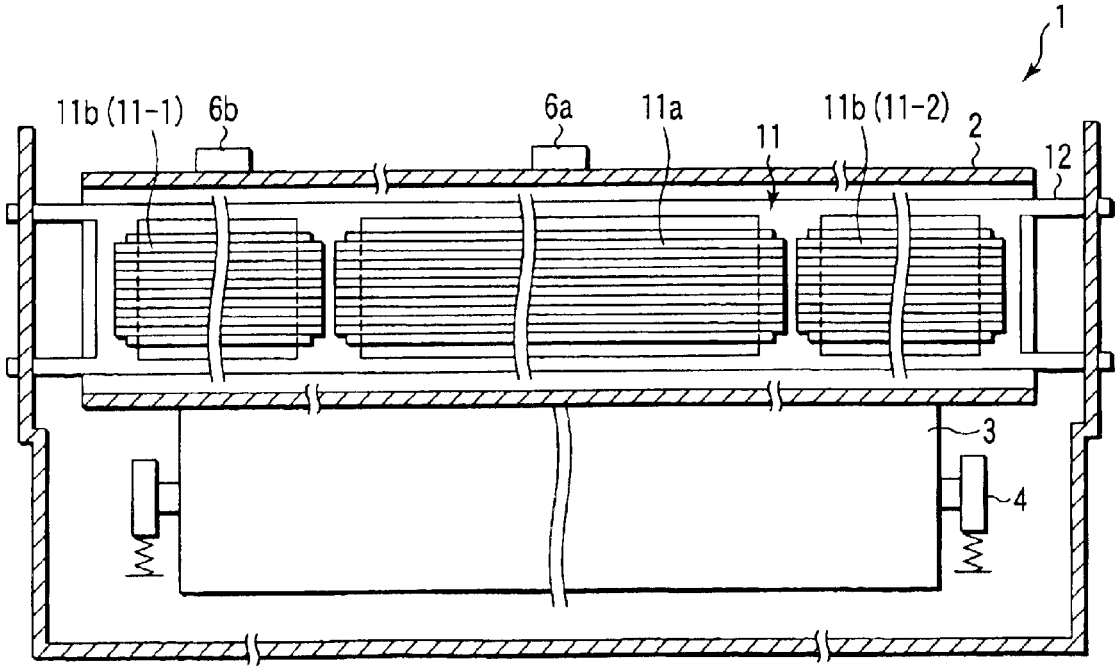
FIG. 2 is a schematic view for illustrating an example of arrangement of an excitation coil which can be utilized in the fixing apparatus shown in FIG. 1.

FIG. 1 is a schematic cross-sectional view showing a state that a fixing apparatus 1 to which the embodiment according to the present invention is applied is cut at the substantial center in the longitudinal direction, and FIG. 2 is a schematic plane view showing a state that the fixing apparatus 1 is seen from the plane direction with a non-illustrated cover and the like of the fixing apparatus shown in FIG. 1 being removed.

The fixing apparatus 1 includes a fixing (heat) roller 2 having a diameter of approximately 20 mm and a press (pressure) roller 3 having a diameter of approximately 20 mm.

The heat roller 2 is a hollow cylindrical body formed of a metal having a thickness of approximately 1 mm, or more preferably approximately 0.5 mm. It is to be noted that the roller 2 is formed of iron in this embodiment but it is possible to use stainless steel, nickel, aluminium or an alloy or the like of stainless steel and aluminium.

On the surface of the heat roller 2 is formed a non-illustrated mold release layer on which a fluorocarbon resin as typified by a tetrafluoride ethylene resin is deposited with a predetermined thickness. A length of the heat roller 2 is, e.g., approximately 340 mm. It is to be noted that the heat roller 2 can be substituted by a metal film having an endless belt type sheet body that a metal with a predetermined thickness is deposited on the surface of a resin film with the high heat resistance.

The pressure roller 3 is an elastic roller that the circumference of the rotary shaft with a predetermined diameter is covered with a silicon rubber or a fluorine rubber with a predetermined thickness.

The pressure roller 3 is substantially parallel with an axial line of the heat roller 2 and pressed against the axial line of the heat roller 2 with a predetermined pressure by a pressure mechanism 4. As a result, a part of the outer peripheral surface of the heat roller 3 is elastically deformed, and a predetermined nip is defined between the both rollers.

In case of using the metal film in place of the heat roller 2, the nip may be formed on the film side in some cases.

The heat roller 2 is rotated at a substantially constant speed in a direction indicated by an arrow by a drum motor 121 which rotates a photoconductor drum 105 or fixing motor 123 which will be described later with reference to FIG. 3.

Since the pressure roller 3 is in contact with the heat roller 23 with a predetermined pressure by the pressurization mechanism 4, rotating the heat roller 2 rotates the pressure roller 3 in a direction opposite to a rotating direction of the heat roller 2.

A position which is on the circumference of the heat roller 2 and at which the heat roller 2 and the pressure roller 3 come into contact with each other is called a nip. A separation claw 5 which separates paper P passed through the nip from the heat roller 2 is placed at a predetermined position which is on the downstream side away from the nip in a direction along which the roller 2 is rotated and in the vicinity of the nip.

At least two temperature detection elements 6*a* and 6*b*, a cleaner 7 and a heat generation defect detection element 8 are provided around the heat roller 2 along the rotating direction and a direction apart from the claw 5 of the roller 2.

The temperature detection elements 6*a* and 6*b* detect a temperature of the outer peripheral surface of the heat roller 2 and, e.g., a thermistor can be utilized as each of these elements. It is to be noted that at least one of the two temperature detection elements 6*a* and 6*b* is positioned at the substantial center in the longitudinal direction of the roller 2. Furthermore, the other element is positioned at one end in the longitudinal direction of the roller 2. It is to be noted that three or more thermistors can be of course provided. Moreover, as will be described later, when the excitation coil is divided into two or more pieces in the longitudinal direction of the roller 2, the thermistors 6*a* and 6*b* are provided in accordance with at least one coil or each coil set.

The cleaner 7 removes the toner which may adhere to the fluorocarbon resin with a predetermined thickness provided on the outer periphery of the heat roller 2, paper powder generated from the paper or foreign particles which float in the apparatus and adhere to the heat roller 2. The cleaner 7 includes a cleaning member formed of a material which hardly damages the fluorocarbon resins, e.g., a felt or a fur brush even if it is brought into contact with the heat roller 2, and a support member which supports the cleaning member.

It is to be noted that the cleaning member may be brought into contact with the surface of the heat roller 2 and rotated, or may be pressed against the outer peripheral surface of the heat roller 2 with a predetermined pressure (non-rotation).

The heat generation defect detection element 8 is, e.g., a thermostat, and utilized to detect a heat generation defect that a surface temperature of the heat roller 2 is abnormally increased and interrupt the power supplied to a later-described heating coil (excitation coil) when the heat generation defect occurs.

It is to be noted that the placing order and the positions of the temperature detection elements 6*a* and 6*b*, the cleaner 7 and the heat generation defect detection element 8 are not restricted to the order and the positions shown in FIG. 1.

On the circumference of the pressure roller 3 is provided a cleaning roller 10 which removes the toner adhering to the separation claw 9 used to separate the paper P from the pressure roller 3 and the peripheral surface of the pressure roller 3.

An excitation coil 11 which generates an eddy current to the material of the roller 2 is arranged inside the heat roller 2. In the example depicted in FIG. 2, the excitation coil 11 is constituted by a first coil 11*a* placed in the vicinity of the substantial center in the longitudinal direction of the heat roller 2 and second coils 11*b* provided in the vicinity of the both ends of the heat roller 2. That is, the second coils 11*b* are useful for heating the vicinity of the both ends of the heat roller 2 as compared with the first coil 11*a* which can heat the vicinity of the center in the longitudinal direction of the heat roller 2. In other words, the second coils 11*b* are separated along an axial line enabling movement of the peripheral surface of the heat roller 2 (or a belt surface when the belt body is used) at a predetermined speed, and the first coil 11*a* is placed in such a manner that it can be arranged between the separated second coils 11*b*. It is to be noted that the respective coils in the second coil 11*b* are referred to as a coil 11-1 and a coil 11-2 when these coils must be individually recognized.

As the first and second coils 11*a* and 11*b* are formed predetermined turn numbers of wire having a predetermined cross section so that they sympathetically vibrate with inherent frequencies and their resistance values becomes maximum.

It is to be noted that, in the example shown in, e.g., FIG. 2, the second coils 11*b* are provided on the both sides with the first coil 11*a* sandwiched therebetween in the longitudinal direction of the heat roller 2. In addition, the first coil 11*a* and the second coils 11*b* may be divided into two pieces at, e.g., the substantial center of the heat roller 2. Additionally, as will be described later with reference to FIG. 20, when the coils are provided to, e.g., the pressure roller 3, a first coil 1011*a* may be arranged on the heat roller 2 side, and a second coil 1011*b* may be arranged on the pressure roller 3 side.

The first and second coils 11*a* and 11*b* are formed so as to be capable of producing predetermined outputs, respectively. It is to be noted that an output from each coil essentially has a current value capable of providing a magnetic flux which can generate an eddy current in order to cause the heat roller 2 (or the pressure roller 3) to generate the heat, but it is managed as a power consumption consumed by the coil in many cases, and hence it will be referred to as a power (or an output) hereinafter. Further, in the example depicted in FIG. 2, a resonance frequency of each coil, i.e., the second coil 11*b* (when 11-1 and 11-2 are connected in series) or at last one of the coils 11-1 and 11-2 included in the second coil is set to a frequency different from a resonance frequency of the first coil 11*a*.

Each of the coils 11*a* and 11*b* is wound around a coil holder 12 which has the high heat resistance, demonstrates the high insulating property and is formed of engineering plastic or ceramics. For the coil holder 12, for example, a PEEK (polyether ether ketone) material, a phenol material, or unsaturated polyester can be utilized. It is to be noted that, in the embodiment depicted in FIG. 1, a core 13 obtained by molding, e.g., ferrite is provided on the inner side of the coil holder 12 and the magnetic flux density which can be used to cause the roller 2 to generate the heat is increased. In this case, for the core 13, for example, a dust core (powder magnetic core) which has less loss in a high frequency band is used as a main material. Furthermore, it is needless to say that an air-cored coil using no core member can be used.

The first coil 11*a* is formed to have a length with which a width which comes into contact with the outer peripheral surface of the roller 2 can be heated when, e.g., the A4size paper is carried in such a manner that its short side becomes parallel with the axial line of the heat roller 2.

The first coil 11*a* and the second coils 11*b* (11-1 and 11-2) are formed of wire each having a cross section of, e.g., 1 $mm^2$. It is to be noted that, as the wire, it is possible to utilize a twisted wire obtained by twisting a plurality of thin wires each having no insulating film or a litz wire obtained by twisting a predetermined number of wires each of which is covered with an insulating material.

Figure 10:
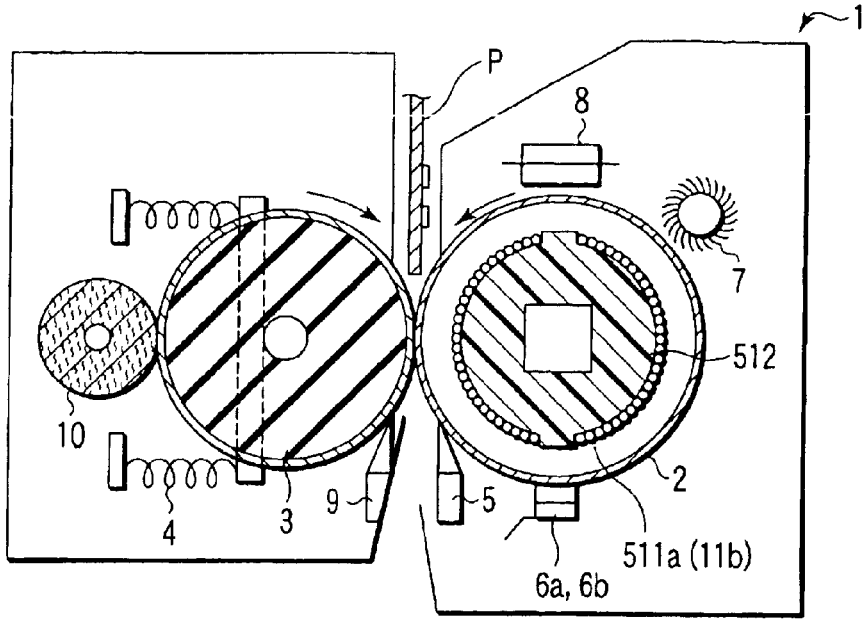
FIG. 10 is a schematic view for illustrating an embodiment that the excitation coil depicted in FIG. 1 are an air-cored coil.

Each of the coils 11*a* and 11*b* can be formed by an arbitrary winding method. For instance, in the example depicted in FIG. 2, a winding direction of the first coil 11*a* is defined as a direction that the wire becomes parallel to the axial direction of the heat roller 2, and a winding direction of the respective coils 11-1 and 11-2 of the second coil 11*b* is defined as a direction that the wire becomes parallel to the axial direction of the roller 2. It is to be noted that, as shown in FIG. 10, each coil can be set along the inner periphery (circle) of the roller 2 by forming each coil into a flat shape that the major part of the Wire used for the coil is arranged so as to be parallel with the longitudinal direction of the roller 2, forming a cross-sectional shape of the coil holder 12 into a cylindrical shape and setting the coil along the peripheral surface of the coil holder 12.

Figure 3:
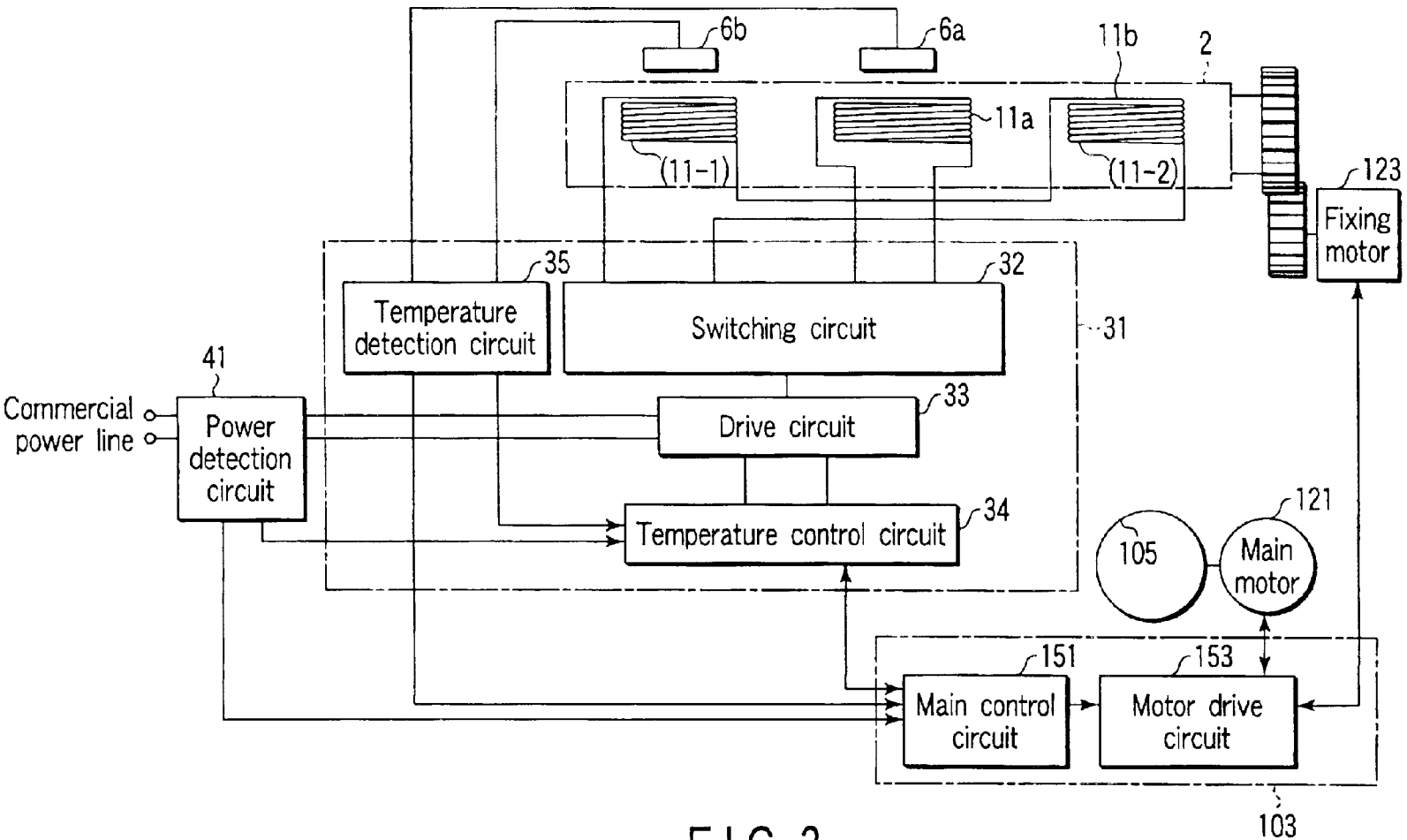
FIG. 3 is a schematic block diagram for illustrating the fixing apparatus depicted in FIGS. 1 and 2 and an example of a control system of an image forming apparatus including the fixing apparatus.

FIG. 3 illustrates a part of a control circuit used to operate a (non-detailed) image forming apparatus in which a drive circuit which operates the fixing apparatus shown in FIGS. 1 and 2 and the fixing apparatus are incorporated.

In the heat roller 2 of the fixing apparatus 1 is accommodated the excitation coil 11 (the coil 11*a* and the coil 11*b* (11-1, 11-2)) which generates an eddy current in the metal material of the heat roller 2 itself and causes heat generation as described above.

To the excitation coil 11 is connected an excitation unit 31 which supplies a high-frequency output (the current and the voltage) having a predetermined frequency to each coil of the excitation coil 11.

The excitation unit 31 includes a switching circuit 32 which can produce a high-frequency output to be supplied to the respective coils 11*a* and 11*b*, and a drive circuit 33 which inputs a predetermined control signal (number of times of switching) to the switching circuit 32 in order to supply a predetermined output to each coil. It is to be noted that the switching circuit 32 connects each of the coils 11*a*, 11-1 and 11-2 in, e.g., series, or connect the coils 11-1 and 11-2, which are connected in series, to the coil 11*a* in parallel, or connect all the coils in parallel.

That is, the switching circuit 32 also functions as a switching device which can arbitrary set the series connection or parallel connection of the respective coils 11*a* and 11*b*, the series connection or parallel connection of 11-1 and 11-2 of the coil 11*b*, or the series connection or parallel connection of the coil 11*a*.

To the switching circuit 32 is supplied a direct-current voltage obtained by rectifying an alternating voltage of the received commercial power by a rectification circuit 131 through the drive circuit 33.

At this moment, the drive circuit 33 informs the switching circuit 32 of the time during which a non-illustrated switching element is on, i.e., the number of times that the switching element is turned on per unit time (driving frequency) in order to produce a high-frequency output which is to be outputted from the switching circuit 32, i.e., produce a coil output which is a predetermined heating power by each of the coils 11*a* and 11*b*. It is to be noted that, in this embodiment, the drive circuit 33 informs the switching circuit 32 of a first frequency $f_1$ to be supplied to the coil 11*a* and a second frequency $f_2$ to be supplied to the coil 11*b*.

In other words, the magnitude of outputting a magnetic flux from each coil, which can be the basis of generating the eddy current produced in the heat roller 2 in order to increase a temperature of the heat roller 2, i.e., the heating power can be set to an arbitrary magnitude by changing an output supplied to each coil from the switching circuit 32 by the control of the drive circuit 33. Furthermore, the heating power is generally subjected to numerical management as a power consumption consumed by each coil. It is to be noted that a coil output (power consumption) of each coil will be simply referred to as a power to be inputted to the coil hereinafter.

Moreover, an arbitrary power from the rectification circuit 131 or the power supplied to all the coils is constantly monitored by a power detection circuit 41 provided at a predetermined position, e.g., between the rectification circuit 131 and an input terminal of the commercial power supply, or between the rectification circuit 131 and the drive circuit 33, or between the drive circuit 33 and the switching circuit 32. It is to be noted that a monitoring result obtained by the power detection circuit 41 is fed back to the drive circuit 33 with a predetermined timing. On the other hand, in order to enable detection of, e.g., burnout of the drive circuit 33, an output from the power detection circuit 41 is also inputted to a main control device 151 of a non-detailed image forming section.

Description will now be given as to an example of the control to increase a temperature of the outer peripheral surface of the heat roller 2 to a predetermined temperature.

As well known, in the induction heating type fixing apparatus 1, magnetic fluxes in predetermined directions are generated from the respective coils 11*a* and 11*b* (11-1, 11-2) of the excitation coil 11 depending on the intensity of the power supplied to each coil and the shape of each coil. Therefore, an eddy current is generated at the metal part of the heat roller 2 so as to obstruct a change in the magnetic fields generated by the magnetic fluxes produced by the coils. Therefore, the Joule heat is generated at the metal part of the heat roller 2 due to the eddy current and a resistance of the metal part itself. When the heat roller 2 generates the heat by this Joule heat, a temperature of the heat roller 2 is increased, and the paper P passed between the heat roller 2 and the pressure roller 3 is heated.

In the regular heating to substantially evenly heat the entire area of the heat roller 2 in the longitudinal direction, the switching circuit 32 described with reference to FIG. 3 supplies a high-frequency output (the current and the voltage) with a predetermined frequency to each of the coils 11*a* and 11*b*. In this case, although described later in connection with FIG. 13, the high-frequency output with the first resonance frequency $f_1$ suitable for generating the magnetic flux from the first coil 11*a* and the high-frequency output with the second resonance frequency $f_2$ suitable for generating the magnetic flux from the second coil 11*b* are alternately inputted to the respective coils. It is to be noted that, when the power with a third frequency $f_{12}$ which is different from the resonance frequencies of all the coils and by which all the coils (although generation of a rated magnetic flux is difficult) can generate the magnetic flux with a predetermined intensity is supplied to all the coils at the same time, a difference in temperature (temperature ripple) which may be generated in the longitudinal direction of the roller can be reduced and the illumination light radiated from the discharge lamp illumination equipment provided in close proximity can be prevented from flickering (generation of the flicker) owing to the fact that the power is alternately inputted (alternate driving) to the respective coils as described above.

The third frequency $f_{12}$ need not be one defined by a point where the curve $P_1$ whose peak is the first frequency $f_1$ intersects with the curve $P_2$ whose peak is the second frequency $f_2$. Rather, the third frequency $f_{12}$ may have any other value between the first frequency $f_1$ and the second frequency $f_2$.

Meanwhile, in case of supplying the power with a predetermined frequency to the first coil and the second coil (whose inductance is smaller than that of the first coil) which have different coil constants as typified by an inductance L, if the switching circuit is independently provided, when a frequency range used to control an output from the first coil in a range of, e.g., 1 kW to 600 W is 20 kHz to 30 kHz, a range of the frequency required for the second coil becomes 30 kHz to 40 kHz by an attempt to control an output from the second coil in a range equivalent to that of the first coil. That is, when changing a coil output from the coil having a different inductance, fluctuations in frequency are small if the respective coils are independently operated.

On the contrary, in cases where the first coil to which a predetermined inductance is supplied and the second coil whose inductance is smaller than that of the first coil are connected to the single switching circuit in parallel and the power with a predetermined frequency is supplied, provided that an output (an amount of heat) from the first coil is 900 W and an output (an amount of heat) from the second coil is 1.1 kW with the frequency of, e.g., 20 kHz, the output (the amount of heat) from the first coil is changed to approximately 500 W whereas the output (the amount of heat) from the second coil becomes approximately 0.9 kW when the frequency is 30 kHz. Additionally, when the frequency is 40 kHz, the output (the amount of heat) from the first coil is decreased to approximately 200 W whereas the output (the amount of heat) from the second coil is maintained at approximately 500 W.

Figure 4:
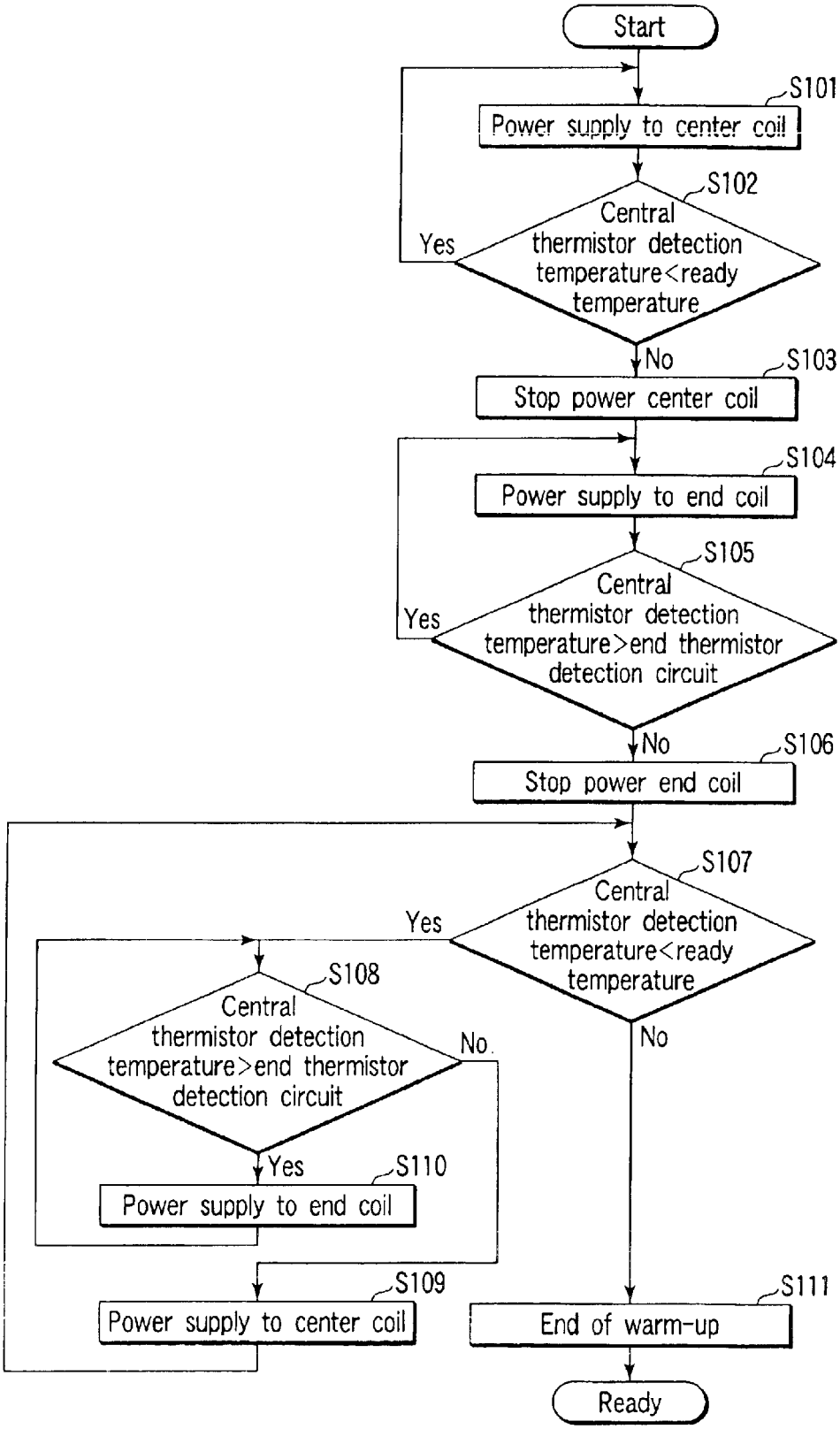
FIG. 4 is a flowchart for illustrating an example of the control to increase a temperature of an outer peripheral surface of a heat roller of the fixing apparatus depicted in FIGS. 1 to 3 to a predetermined temperature.

FIG. 4 illustrates an example of the control in the warm-up operation until a temperature of the surface of the heat roller 2 in the fixing apparatus 1 reaches a predetermined temperature.

As shown in FIG. 4, a predetermined power is first applied to the coil 11*a* which increases a temperature at the central part of the heat roller 2, for example. At this moment, the power with the frequency $f_1$ is supplied to the coil 11*a*. As a result, a resistance value of the coil 11*a* becomes maximum, and a predetermined magnetic flux is generated from the coil 11*a*. Therefore, the substantial central part of the heat roller 2 is caused to generate the heat due to the eddy current, and a temperate at this part is increased (S101).

Thereafter, the power with the frequency $f_1$ is supplied to the central coil 11*a* until the temperature at the central part of the roller 2 exceeds a standby temperature, e.g., 180° C. (S102, S102—Yes). It is to be noted that a temperature of the heat roller 2 is constantly monitored by the first thermistor 6*a* and informed to a temperature control circuit (CPU) 34 through the temperature detection circuit 35.

At a step S102, when the thermistor 6*a* detects that the temperature of the heat roller 2 has exceeded 180° C. (S102—No), the power supply to the coil 11*a* is stopped (S103).

Then, in order to increase a temperature at the both ends of the heat roller 2, a power with the frequency $f_2$ whose intensity is substantially equal to that of the power supplied to the central (first) coil 11*a* is supplied to the end (second) coils 11*b* (S104).

Thereafter, the power is supplied to the coils 11*b* until the temperature at the both ends of the roller 2 becomes higher than the temperature at the center of the roller 2. It is to be noted that the temperature of the roller 2 is constantly monitored by the thermistor 6*b* and informed to the temperature control circuit 34 through the temperature detection circuit 35 (S105, S105—Yes).

At a step S105, when it is detected that the temperature at the both ends of the roller 2 has exceeded the temperature at the central part of the roller 2 (S105—No), the power supply to the coils 11B is stopped (S106).

When energization of the coils 11*b* is stopped at the step S106, the temperature at the central part of the roller 2 detected by the first thermistor 6*a* is a standby temperature. For example, whether the temperature has reached 180° C. is checked (S107). It is to be noted that, when the temperature at the central part of the roller 2 likewise maintains the standby temperature when the temperature at the both ends of the roller 2 has reached the standby temperature (S107—Yes), the warm-up operation is terminated as will be described later (S111).

When the temperature at the central part of the roller 2 detected by the thermistor 6*a* is yet to reach 180° C. at the step S107 (S107—Yes), the temperature at the both ends of the roller 2 is compared with the temperature at the central part of the roller 2 (S108).

At a step S108, whether the temperature at the central part of the roller 2 is lower than the temperature at the both ends of the roller 2 (S108—No) or whether the temperature at the central part of the roller 2 is higher than the temperature at the both ends of the roller 2 (S108—Yes) is detected.

Thereafter, in order to increase the lower temperature of either that at the central part of the roller 2 or that at the both ends, the power with a predetermined frequency (the power with the frequency $f_2$ for the end coils, and the power with the frequency $f_1$ for the center coil) is supplied to the low-temperature coil capable of increasing the temperature on the low temperature side (S107 to S110).

It is to be noted that the resonance frequency of each coil is changed under the influences of an increase in temperature of the coil and the holder, a temperature of the roller, a secular changes in the roller diameter and others.

Therefore, it is needless to say that monitoring is carried out in such a manner that a total quantity of the power supplied from the rectification circuit 131 to the coil or of the power inputted to the copying apparatus does not exceed the maximum power which can be inputted to the copying apparatus.

Moreover, in cases where the coils to which the power is supplied are switched based on a temperature of the roller 2 detected by the thermistors 6*a* and 6*b,* when the power is first supplied to each coil, the well-known soft start can prevent an excessive inrush current from being generated. It is to be noted that the flicker may occur in the discharge lamp illumination provided in close proximity even if the soft start is used, and hence it is preferable to switch the coils when a current waveform of the commercial power inputted to the rectification circuit 131 becomes 0 V (zero cross) if the coils to which the power is supplied are switched.

In addition, in a temperature control routine described in connection with FIG. 4, description has been given as to the example that the temperature at the center of the roller is increased to the standby temperature and the temperature at the both ends of the roller is then increased, but an arbitrary temperature control routine can be used if the temperature of the roller in the longitudinal direction can be evenly increased. For example, the temperature at the both ends of the roller may be first increased to a set temperature, and then the temperature at the center of the roller may be increased to a set temperature. Additionally, since the temperature at the both ends of the roller may largely fluctuate depending on the size of the power on which fixation (image formation) is carried out in some cases, it is possible to manage the temperature only at the center of the roller.

It is to be noted that the temperature detected by the thermistor may be mainly utilized for managing the upper limit of the temperature of the roller, and the power may be alternately supplied to each of the coil 11*a* (for heating the center of the roller) and the coils 11*b* (for heating the roller ends) at predetermined time intervals when increasing the temperature from the ready mode or performing the fixation operation.

Further, it is also useful to restrict a total quantity of the magnetic fluxes outputted from the respective coils by thinning a part of the power inputted to each coil from the rectification circuit 131 with a predetermined timing at predetermined intervals and selectively supplying this power. At this moment, when the thinned power (lapsed power) exceeds a predetermined quantity, the illumination light from the discharge lamp illumination (fluorescent lamp) provided in close proximity may flicker (generation of flicker). It is, therefore, preferable to provide a compensation capacitor having a predetermined capacity in order to recover the lapsed power.

It is to be noted that the coil constant is set to each coil so that each coil vibrates sympathetically with a different resonance frequency. Furthermore, if the two coils 11-1 and 11-2 in the coil 11*b* and the coil 11*a* are all connected in series, when the relationship between the resonance frequency $f_1$ of the coil 11*a* and the resonance frequency $f_2$ of the coil 11*b* are set to $1:1/\sqrt{2}$, the resonance frequency f2 of each of the coils 11-1 and 11-2 of the coil 11*b* is 1 MHz (the resonance frequency of the entire coil 11*b* is $1/\sqrt{2}$) provided that the resonance frequency $f_1$ of the coil 11*a* is 2 MHz. That is, a frequency indicated to the switching circuit 32 by the drive circuit 33 is set to 2 MHz in order to increase the temperature of the coil 11*a* (center of the heat roller 2), and the same frequency is set to $1/\sqrt{2}$ MHz in order to increase the temperature of the coil 11*b* (ends of the roller 2). As a result, it is possible to reduce the influence of the flicker generated due to switching of the coils to which the power is supplied.

As described above, as compared with the example that the temperature of the entire heat roller 2 over its length is increased (the high-frequency output with a predetermined frequency is applied to all the coils at the same time) or that the drive current is evenly applied to the coil 11*a* and the coil 11*b*, first increasing the temperature at the central part of the roller 2 can increase the temperature of the roller 2 over the entire length to a predetermined temperature with less power consumption in a short time.

Furthermore, since the power to be supplied to the coil 11*a* used to increase the temperature at the center of the roller is set substantially equal to the power supplied to the coil 11*b* used to increase the temperature at the ends of the roller, occurrence of the interference noise, the flicker or the like can be decreased even if the coils to which the power is supplied are alternately switched as shown in FIG. 4. It is to be noted that completely equalizing the power supplied to the respective coils is difficult, but it is possible to allow, e.g., approximately 30% of the maximum power (power which can be inputted) consumed by all the coils, i.e., approximately 200 W in the fixing apparatus shown in FIGS. 1 to 3.

Figure 5:
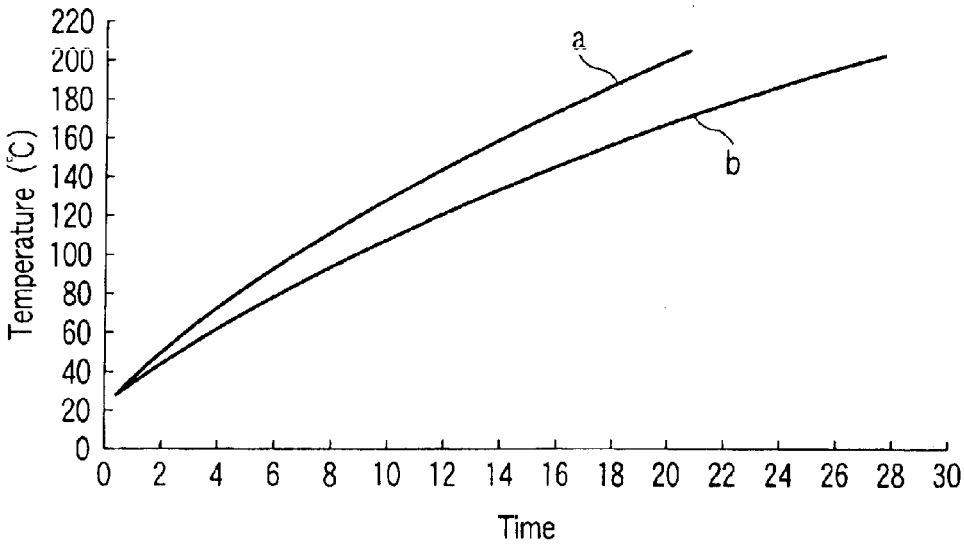
FIG. 5 is a graph for illustrating a time required for increasing a temperature of the heat roller of the fixing apparatus explained in connection with FIGS. 1 to 3.

FIG. 5 illustrates a state that a temperature increasing speed of the roller 2 is increased by using the embodiment described in connection with FIGS. 1 to 3.

In FIG. 5, a curve a indicates an increase in temperature when performing management with a frequency of the power supplied to the first (central) coil being set as 2.5 MHz and a coil output being set as 1.2 kW. In FIG. 5, a curve b indicates a temperature increasing characteristic when the power with a frequency of 25 kHz is supplied to the coils in the fixing apparatus using wires having large cross sections for the purpose of comparison.

From the curve a and the curve b, it is recognized that the time required for increasing the roller temperature to, e.g., 180° C. is reduced 25% or more.

Description will now be given as to the relationship between the frequency of the power supplied to each coil and the coil output.

For example, the power supplied to each of the coils 11*a* and 11*b* can be arbitrarily changed within a range of, e.g., 700 W to 1.5 kW in terms of the power consumption consumed by each coil.

In order to set the output from each coil in a range of, e.g., 700 W to 1.5 kW, the number of times that the frequencies $f_1$ and $f_2$ of the power supplied to the respective coils 11*a* and 11*b* through the switching circuit 32, i.e., the direct-current voltage supplied from the rectification circuit 131 is, e.g., approximately 1 MHz to 4 MHz as described above. It is to be noted that, when the high-frequency power of 1 MHz to 4 MHz is supplied to each coil, an actual value of the current flowing through an arbitrary coil is set to approximately 1 A although this value varies depending on the power supply condition of a country or an area where the non-illustrated copying apparatus is set.

As well known, the intensity of the current flowing through an arbitrary coil 11*a* or 11*b* (11-1, 11-2) of the excitation coil 11 can be obtained by setting the frequency applied to the coil, the impedance and others.

For example, when the powers which are different only in frequency are supplied to the same coil, even if the current value is 10 mA, the impedance is also increased as the frequency is higher because these values vary as follows.

25 kHz:

Inductance L=24.6 $\mu$H,

Pure resistance R=1.2 Ω.

100 kHz:

Inductance L=18.69 $\mu$H,

Pure resistance R=3.5 Ω,

1 MHz:

Inductance L=15.1 $\mu$H,

Pure resistance R=4.9 Ω.

Assuming that the wire used for each coil is copper, since the penetration depth of the alternating current obtained by the skin effect is in inverse proportion to the ½ power of each of the frequency, the relative permeability, and the electric conductivity, the frequencies to be applied are as follows.

$3.8\times10^{-4}$ m in case of 30 kHz; and $3.8\times10^{-5}$ m in case of 3 MHz Therefore, assuming that the frequency of the voltage applied to an arbitrary coil from the switching circuit 32 described in connection with FIG. 5, the penetration depth is approximately 0.04 mm, and hence it is desirable that the diameter of the wire used for each coil is smaller than 0.2 mm.

The cross section of the wire having the diameter of 0.2 mm is as follows.

$$0.1^2\pi=0.0314\ \text{mm}^2$$

Incidentally, if the copper single wire having the diameter of 0.1 mm can be used, the cross section is as follows.

$$0.05^2\pi=0.00785\ \text{mm}^2$$

However, in the general (well-known) induction heating type fixing apparatus, provided that a coil current required for obtaining an output of 1 kW is 25 A, the cross section of the wire is as follows.

$$0.25^2\ \pi\times19=0.73\ \text{mm}^2$$

That is, even if the influence of the skin effect is not taken into consideration, the cross section of the wire required per coil current of 1 A is as follows.

$$3.73\ \text{mm}^2/25=0.1492\ \text{mm}^2$$

Therefore, since the copper single wire having the diameter of 0.2 mm or 0.1 mm lacks the current capacity, in case of using the copper single wire having the diameter of 0.2 mm, the litz wire obtained by twisting five coated wires must be used based on the following expression.

$$0.1492/0.0314=4.75\ \text{(number of wires)}$$

It is to be noted that, in case of using the copper single wire having the diameter of 0.1 mm, it can be recognized that using the litz wire obtained by twisting 19 coated wires can suffice based on the following expression.

$$0.1492/0.00785=19.0\ \text{(number of wires)}$$

As described above, determining the frequency of the high-frequency output supplied to each coil as, e.g., 1 MHz to 4 MHz, the current flowing through each coil can be reduced. That is, since the outside diameter of the coil is reduced, the outside diameter of the heat roller 2 in which that coil is arranged is also reduced to approximately ½ as compared with the currently utilized roller having the diameter of approximately 40 mm. Incidentally, assuming the Dh is the outer shape of the heat roller and d is the outside diameter of the coil holder, it can be expected that the minimum value of the outside diameter of the heat roller which can be realized can be reduced to the outside diameter obtained by the following expression.

$$Dh\times0.8-d\geqq6\ \text{(mm)}:$$

where 6 (mm) is the size of a space of the core material if the core material exists or a space of the inner mold at the time of molding in case of the air-cored coil, and 0.8 is a coefficient considering a thickness of the coil.

As an example, although the diameter (Dh) of the heat roller in the fixing apparatus described in connection with FIG. 1 is approximately 20 mm, the following expression can be obtained provided that the diameter (d) of the core material is 6 mm, and the above computation expression is satisfied.

$$20\times0.8-6\geqq6\ \text{(mm)}$$

It is to be noted that the diameter of the wire used for the coil is 1 mm and the wall thickness of the roller is 1 mm in this example.

Figure 6:
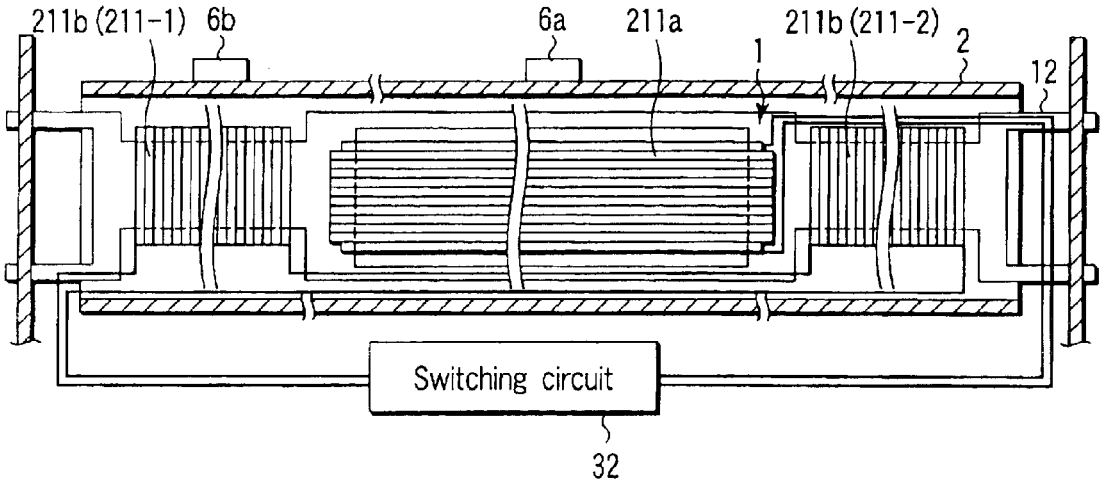
FIG. 6 is a schematic view for illustrating another embodiment of the excitation coil depicted in FIG. 2.
Figure 7:
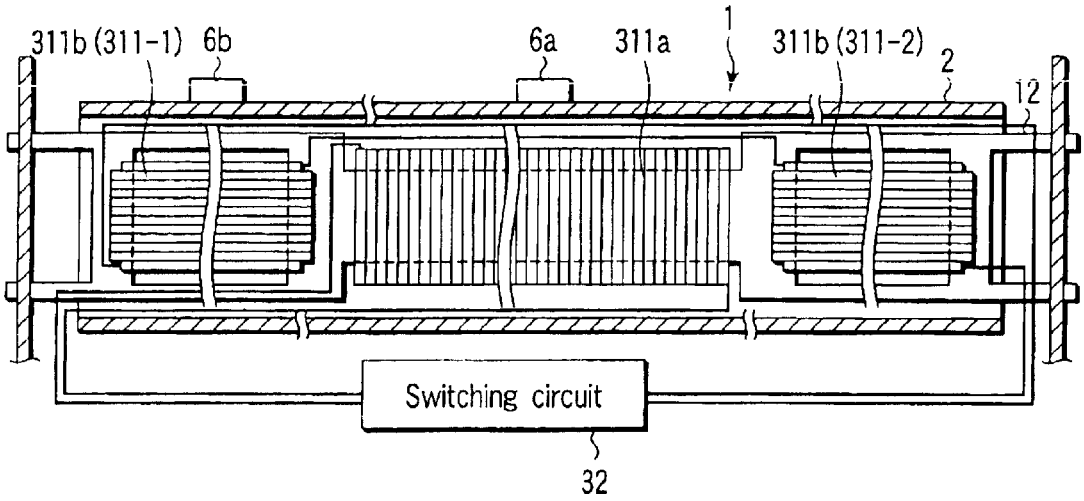
FIG. 7 is a schematic view for illustrating still another embodiment of the excitation coil depicted in FIG. 2.
Figure 8:
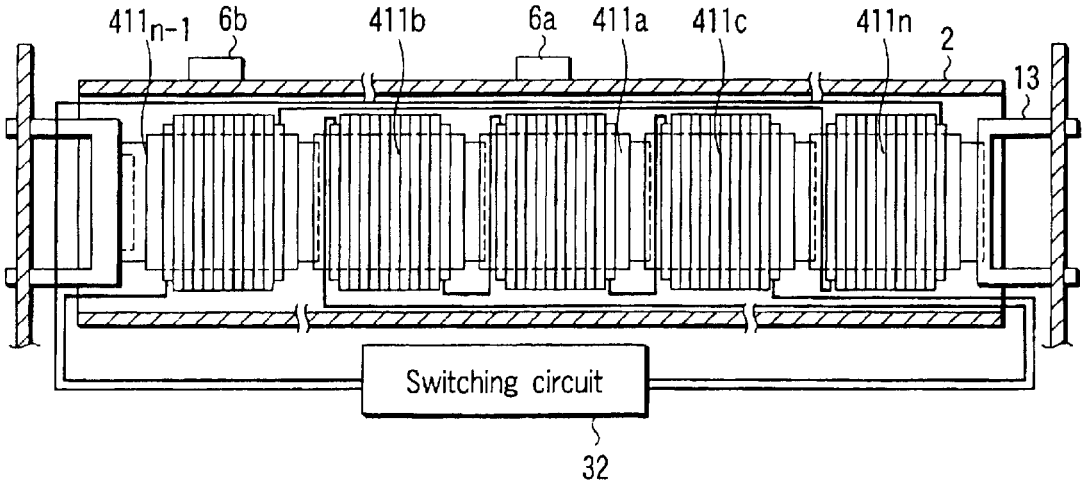
FIG. 8 is a schematic view for illustrating yet FIG. 2.

FIGS. 6 to 8 are schematic views for illustrating the characteristics of the winding direction of each coil described in connection with FIGS. 1 and 2.

FIG. 6 illustrates another example of the winding method of each coil when forming the excitation coil.

As shown in FIG. 6, in the excitation coil 211, the winding direction of the wire of the first (central) coil 211*a* is defined in such a manner that the wire becomes parallel with the axial direction of the roller 2, and winding direction of the wire of the second (end) coil 211*b* (211-1, 211-2) is defined in such a manner that the wire becomes parallel to the circumferential direction of the roller 2. It is to be noted that the respective coils 211-1 and 211-2 included in the second coil 211*b* are connected in series.

The first coil 211*a* and the second coil 211*b* are connected in parallel by the switching circuit 32, and the powers with the first frequency $f_1$ or the third frequency $f_{12}$ and the second frequency $f_2$ or the third frequency $f_{12}$ are supplied to the respective coils.

FIG. 7 illustrates still another example of the winding method of the individual coils when forming the excitation coil.

As shown in FIG. 7, in the excitation coil 311, the winding direction of the wire of the first (central) coil 311*a* is defined in such a manner that the wire becomes parallel to the circumferential direction of the roller 2, and the winding direction of the wire of the second (end) coil 311*b* (311-1, 311-2) is defined in such a manner that the wire becomes parallel to the axial direction of the roller 2. It is to be noted that the respective coils and the switching circuit 32 are connected in the same manner as described with reference to FIG. 6, and the powers with the frequency $f_1$ or the third frequency $f_{12}$ and the frequency $f_2$ or the third frequency $f_{12}$ are supplied to the respective coils.

FIG. 8 illustrates yet another example of the winding method of the respective coils when forming the excitation coil.

As shown in FIG. 8, the excitation coil 411 is characterized in that a plurality of unit coils 411*a*, 411*b*, . . . , 411*n*-1 and 411*n* divided with a predetermined length along the longitudinal direction of the heat roller 2 are arranged in series. It is to be noted that the winding direction of the wire in each unit coil may be any direction as long as the winding directions of all the coils are the same.

As described above, when using a plurality of the unit coils 411*a*, 411*b*, . . . , 411*n*-1 and 411*n*, it is possible to provide units that the individual unit coils have the same shape and the same number of turns by optimizing the length of each unit coil. Therefore, when a maximum width of the paper on which an image can be formed differs depending on, e.g., the specification of the copying machine, it is good enough to change the number of units in accordance with a length of the roller (width of the paper).

Further, when only the unit coils 411*n*-1 and 411-*n* arranged at the both ends are independently formed and the remaining unit coils arranged in the middle part have the same shape and the same number of turns, a temperature distribution of the roller in the longitudinal direction can be associated with a width of the paper which is frequently used for image formation.

Incidentally, as shown in FIG. 8, when a plurality of the unit coils are used, it is good enough to connect the unit coils 411*n*-1 and 411-*n* at the both ends in series and supply the power with the second resonance frequency $f_2$ or the third frequency $f_{12}$ to them like the end coils described above, and connect the remaining coils arranged in the middle part in series and supply the power with the first resonance frequency $f_1$ or the third frequency $f_{12}$ to them like the central coil described above.

FIGS. 9A to 9F illustrate a shape of a bobbin of the unit coil utilized in the excitation coil depicted in FIG. 8 and its molding method, and characteristics when forming the coil by winding the wire.

As shown in FIGS. 9A to 9F, in order to form a coil with a predetermined length by connecting an arbitrary number of the unit coils depicted in FIG. 8, the bobbins of the individual unit coils must have the simple structure and must be stably connected to each other.

Figure 9A:
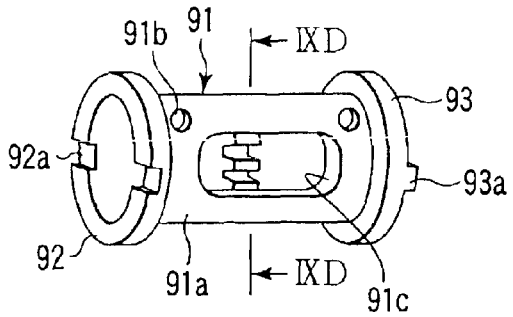
FIGS. 9A to 9F are schematic views for illustrating characteristics of each coil body and bobbin of the excitation coil depicted in FIG. 8.

As shown in FIG. 9A, a bobbin 91 has a hollow cylindrical portion 91*a* and flanges 92 and 93 integrally formed at the both ends thereof.

Figure 9D:
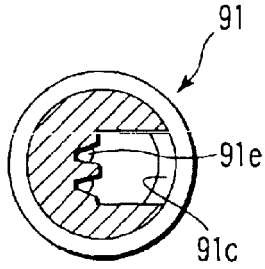
Figure 9B:
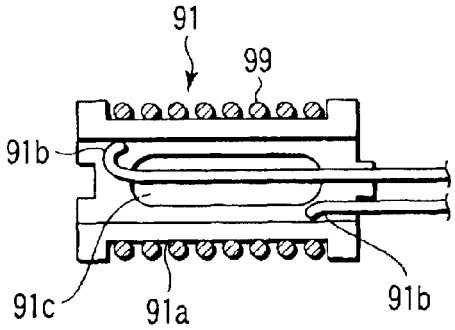

As shown in FIG. 9B, to the cylindrical portion 91*a* of the bobbin 91 are formed a predetermined number of holes 91*b* through which the wire 99 forming the coil is inserted from the inner side of the cylindrical part to the outer side of the same or from the outer side to the inner side of the same. Furthermore, to the cylindrical portion 91*a* may be formed an opening 91*c* which is defined to have a predetermined area useful for a reduction in weight of the bobbin and heat radiation.

Figure 9E:
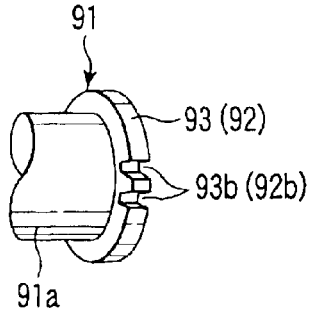
Figure 9C:
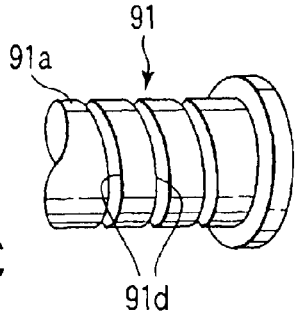

Moreover, such a guide groove 91*d* as shown in FIG. 9C may be formed to the cylindrical portion 91*a* in order to guide the wire when the arrangement of the wire 99 used for coil is coarse.

An internal guide groove 91*e* such as shown in FIG. 9D is provided to the inside of the cylindrical portion 91*a* in order to suppress undesirable movement in the cylindrical portion when the wire 99 used for coil is wound in the cylindrical portion.

A concave portion 92*a* and a convex portion 93*a* used to connect the unit coils with each other are provided to the flanges 92 and 93. It is to be noted that, when the wire 99 used for the coil is configured to be wound around the coil surface, such external grooves 92*b* and 93*b* as shown in FIG. 9E used for guiding the wire may be respectively provided to the flanges 92 and 93.

Figure 9F:
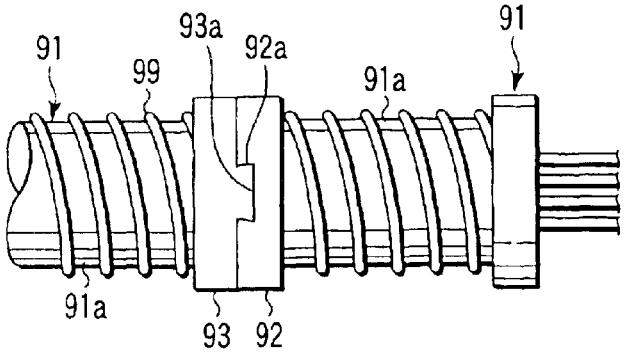

FIG. 9F shows a state that the two unit coils formed by the bobbins 91 depicted in FIGS. 9A to 9E are connected to each other. It is to be noted that the example shown in FIG. 9F is an instance of using the bobbin to which the internal guide groove shown in FIG. 9D is provided and hence the wire used to connect the coils with each other or connect the switching circuit with the coils is wound in the cylindrical part of the bobbin 91.

FIG. 10 illustrates an example of a cross section of the coil when the excitation coil is an air-cored coil.

As shown in FIG. 10, the excitation coil 511 accommodated in the heat roller 2 can be determined as flat coils 511*a* and 511*b* each of which is formed by a litz wire obtained by bundling 19 wires that copper wires each having a diameter of 0.1 mm are insulated from each other by polyamide-imide, and the respective coils can be set along the inner periphery of the heat roller 2 by arranging the outer periphery of each coil along the coil holder 512.

In the fixing apparatus shown in FIG. 10, since the frequency of the output applied to each coil can be increased, the cross section of the wire used for the coil can be reduced, and hence the heat roller with the small outside diameter can be used.

Moreover, by arranging a plurality of the coils in the axial direction of the heat roller and selectively supplying the power with a predetermined frequency to each coil, the drive circuit and the switching circuit can be integrated as one. As a result, the temperature increasing capability can be improved without increasing the power consumption.

Figure 11:
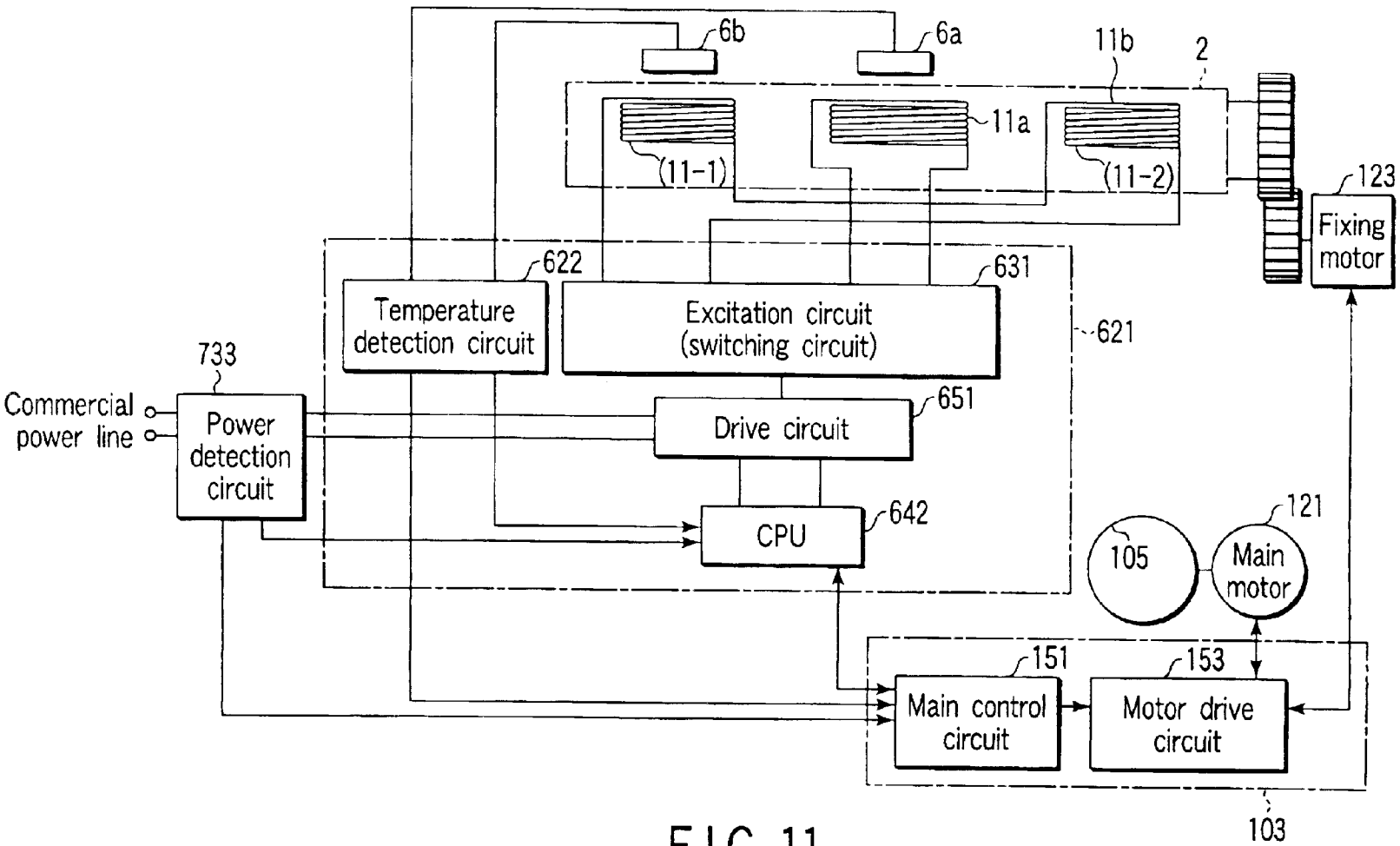
FIG. 11 is a schematic block diagram for illustrating an example of another embodiment of the control system depicted in FIG. 3.

FIG. 11 is a schematic block diagram illustrating an example of another embodiment of the control system shown in FIG. 3.

As described above in connection with FIGS. 1 and 2, the excitation coil 11 (the coil 11*a* and the coil 11*b* (11-1, 11-2)) which generates an eddy current to the metal material of the heat roller 2 itself and causes heat generation as mentioned above is accommodated in the heat roller 2 of the fixing apparatus 1.

As apparent from FIG. 11, to the excitation coil 11 is connected an excitation unit 621 which supplies a high-frequency output (the current and the voltage) with a predetermined frequency to each coil in the excitation coil 11.

The excitation unit 621 includes a temperature detection circuit 622 which converts temperature indication values supplied from the first and second thermistors 6*a* and 6*b* into digital signals, an excitation circuit (switching circuit) 631 which supplies the powers with the first frequency $f_1$, the second frequency $f_2$ and the third frequency $f_{12}$ to the individual coils 11*a* and 11*b*, a CPU 642 which sets a frequency of the power to be outputted from the excitation circuit 631 based on a temperature of the roller 2 detected by the temperature detection circuit 622, a drive circuit 651 which outputs the frequency directed by the CPU 642 to the excitation circuit 631 and inputs to the excitation circuit 631 a drive output obtained by rectifying an alternating output of the commercial power supplied from the outside, and others. It is to be noted that a power detection circuit 733 is provided between the non-detailed commercial power supply and the drive circuit 651 according to needs.

In addition, the excitation circuit (switching circuit) 631 can connect all of the coils 11*a* , 11-1 and 11-2 in series, or connect the coils 11-1 and 11-2, which are connected in series, to the coil 11*a* in parallel, or connect all the coils in parallel, for example. That is, the switching circuit 631 also functions as a switching device which can arbitrarily set the series connection or the parallel connection of the individual coils 11*a* and 11*b*, or the direct or parallel connection of 11-1 and 11-2 of the coil 11*b*, or the direct or parallel connection relative to the coils 11*a*.

To the switching circuit 631 is directed, as an output from the drive circuit 651 under control of the CPU 642, the later-described time during which the switching element is on, i.e., the number of times that the switching element is turned on per unit time (drive frequency) in order to cause the switching circuit 631 to produce a high-frequency output, i.e., arbitrary coils 11*a* and 11*b* to produce coil outputs which are predetermined heating powers. It is to be noted that the drive circuit 651 directs to the switching circuit 631 the first frequency $f_1$ to be supplied to the coil 11*a*, the second frequency $f_2$ to be supplied to the coil 11*b* and the third frequency $f_{12}$ with which the both coils can simultaneously produce predetermined outputs.

In this case, each frequency may be changed by, e.g., approximately several-hundred Hz in accordance with an increase in temperature of the roller and heat generation of the wire of the coil or a change in resistance value due to an increase in temperature inside the non-illustrated copying apparatus and the like in some cases.

In other words, the intensity, i.e., the heating power by which each coil outputs a magnetic flux which can be a basis of generating an eddy current to the heat roller 2 in order to increase a temperature of the heat roller 2 can be set to an arbitrary value by a change in output fed from the switching circuit 631 to each coil under the control of the drive circuit 651. Additionally, the heating power is generally numerically managed as the power consumption consumed by each coil. It is to be noted a coil output (power consumption) of each coil will be simply referred to as a power inputted to the coil hereinafter.

It is to be noted that a quantity of power detected by the power detection circuit 733 is fed back to the drive circuit 651 with a predetermined timing. Further, in order to enable detection of burnout or the like of the drive circuit 651, an output from the power detection circuit 733 is also inputted to a main control device 151 of the non-detailed image forming section.

Figure 12:
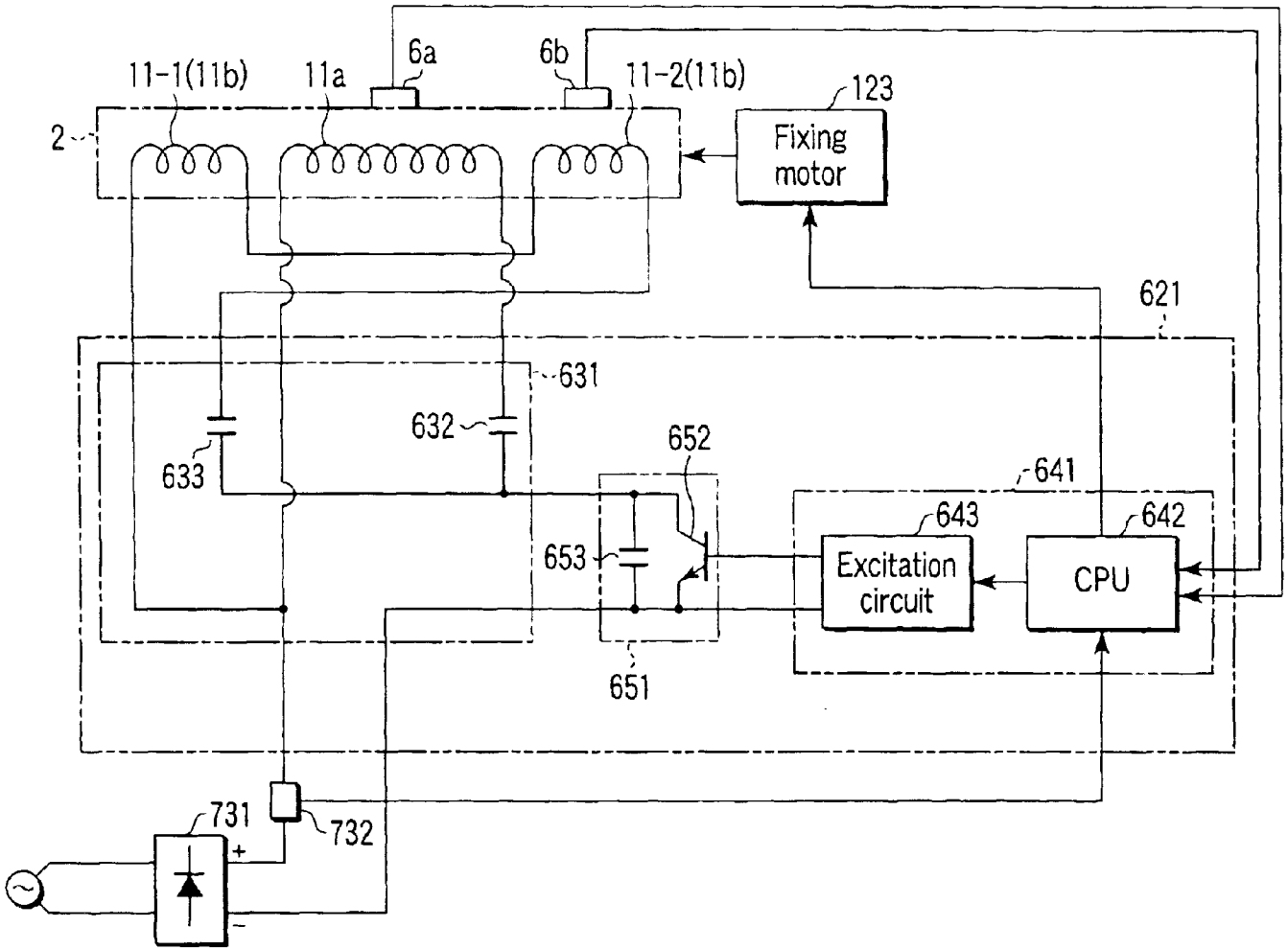
FIG. 12 is a block diagram for illustrating an example of an excitation unit incorporated in the control system depicted in FIG. 11.

FIG. 12 illustrates the excitation unit described with reference to FIG. 11 in further detail.

The excitation circuit 631 includes a capacitor 632 connected to the first coil 11*a* in series, and a capacitor 633 connected to the second coil (11-1, 11-2) in series. The control unit 641 includes the above-described CPU 642, and an excitation circuit 643 capable of outputting a control signal with an arbitrary frequency. The drive circuit 651 includes a switching element 652 and a capacitor 653, and switches a rectification output fed from the rectification circuit 131 with a frequency of the control signal supplied from the excitation circuit 643 and supplies it to the excitation circuit 631. It is to be noted that a current supplied to each coil is detected by the detector 132 between the drive circuit 632 and the control unit 641.

Figure 13:
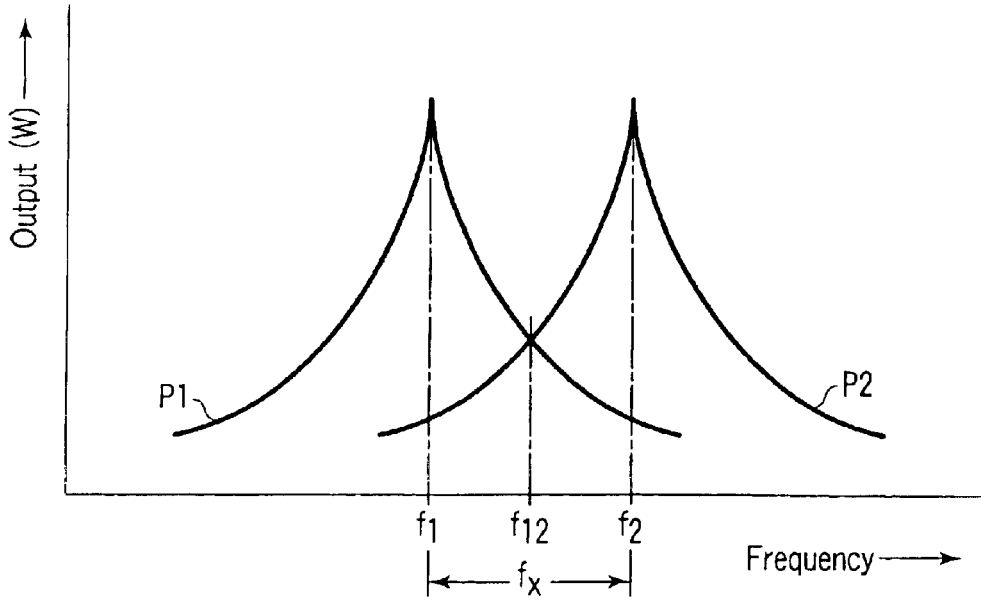
FIG. 13 is a schematic view for illustrating a fundamental principle that the excitation unit depicted in FIG. 11 can be used to output a first resonance frequency $f_1$, a second resonance frequency $f_2$ and a third resonance frequency $f_{12}$ by which any coil can simultaneously produce an output which has a predetermined ratio relative to a fixed output.

FIG. 13 illustrates the relationship between a frequency of the control signal outputted from the excitation circuit depicted in FIG. 12 and an output from each coil.

As described above, the first and second coils 11*a* and 11*b* used to cause the roller 2 to generate the heat are operated with a first resonance frequency as the frequency $f_1$ and a second resonance frequency $f_2$ as the second frequency $f_2$ as well as a third resonance frequency as the frequency $f_{12}$ with which the both coils hardly produce a rated output but they can produce an output which has a predetermined ratio relative to the rated output.

As shown in FIG. 13, in the continuous frequency which is indicated by a curve $P_1$ and with which the first coil 11*a* can generate the magnetic flux, an output from the first coil 11*a* becomes maximum with the resonance frequency $f_1$. Likewise, in the continuous frequency which is indicated by a curve $P_2$ and with which the second coil 11*b* can generate the magnetic flux, an output from the second coil 11*a* becomes maximum with the resonance frequency $f_2$. It is to be noted that the frequency with which the both coils 11*a* and 11*b* can simultaneously generate a predetermined magnetic flux is an arbitrary frequency in a frequency $f_x$ defined by an area where the curve $P_1$ overlaps the curve $P_2$.

Furthermore, the third frequency $f_{12}$ with which the magnetic flux which can be generated by the both coils with the same frequency becomes maximum is a frequency at a point where the curve $P_1$ crosses the curve $P_2$.

The frequency $f_x$ need not be one defined by a point where the curve $P_1$ whose peak is the first frequency $f_1$ intersects with the curve $P_2$ whose peak is the second frequency $f_2$. Rather, the frequency $f_x$ may have any other value between the first frequency $f_1$ and the second frequency $f_2$.

From FIG. 13, it can be recognized that, when a difference between the first and second resonance frequencies $f_1$ and $f_2$ is reduced, the output which can be produced by the both coils 11*a* and 11*b* can be increased by using the third resonance frequency $f_{12}$. On the other hand, when a difference between the first and second resonance frequencies $f_1$ and $f_2$ is small, the power consumed by the both coils 11*a* and 11*b* is increased, and hence the individual resonance frequencies are set taking the maximum power which can be inputted to the non-detailed copying apparatus into consideration. It is to be noted that the maximum power which can be inputted can be readily detected by making reference to an output of the power detection circuit 733 shown in FIG. 11 if this circuit is provided. Moreover, when the power detection circuit 733 is not provided, it is good enough to monitor the intensity of the input current by making reference to the output from the current detection circuit 732.

Description will now be given as to an example of the control to increase a temperature of the outer peripheral surface of the heat roller 2 to a predetermined temperature.

As well known, in the fixing apparatus 1 which is of the induction heating type, each of the coils 11*a* and 11*b* (11-1, 11-2) in the excitation coil 11 generates a magnetic flux in a predetermined direction depending on the intensity of the power supplied to each coil and the shape of each coil. Therefore, the eddy current is generated at the metal part of the heat roller 2 so as to prevent a magnetic field generated by the magnetic flux produced by each coil from being changed. Therefore, the Joule heat is generated at the metal part of the heat roller 2 due to a the eddy current and the resistance of the metal part itself. The temperature of the heat roller 2 is increased by heat generation of the heat roller 2 owing to the Joule heat, and the paper P passed between the heat roller 2 and the pressure roller 3 is heated.

In detail, as described above with reference to FIGS. 11 to 13, the temperature of the surface of the heat roller 2 can be controlled independently in the vicinity of the center in the longitudinal direction of the roller 2 whose temperature is increased by the first coil 11*a* and at the both ends in the longitudinal direction of the roller 2 whose temperature is increased by the second coil 11*b*.

The frequency of the power supplied to each of the coils 11*a* and 11*b* is set by the CPU 642 based on temperature data which is output from the temperature detection circuit 22 and indicates a temperature of the heat roller 2 in the vicinity of the center of the outer peripheral surface thereof detected by the first thermistor 6*a* and temperature data which indicates a temperature at the both ends of the roller 2 detected by the second thermistor 6*b*. The frequency set by the CPU 642 is directed to the excitation circuit 643 as a control signal. It is to be noted that a motor pulse is supplied from the main control circuit 151 on the non-detailed copying apparatus side to, e.g., a fixing motor 123 used to rotate the roller 2, i.e., a motor drive circuit 153 based on a temperature difference outputted from the temperature detection circuit 622.

Moreover, data indicative of the correspondence relationship between the temperature data and the output, the first to third resonance frequencies $f_1$, $f_2$ and $f_{12}$ set by the CPU 642, a switching timing used to output each frequency and others are previously stored in a non-illustrated memory in which, e.g., data can be rewritten. It is to be noted that, although not described in detail, the data stored in the memory can be arbitrarily rewritten in accordance with power supply conditions of a country or an area in which the copying apparatus is set or a maximum value of the power which can be inputted and allowed for the copying apparatus in which the fixing apparatus 1 is incorporated.

On the other hand, the main control circuit 151 on the copying apparatus side can detect a defect in, e.g., any of the thermistors 6*a* and 6*b* or the temperature detection circuit 622 based on the temperature data outputted from the temperature detection circuit 622. That is, when any defect is generated in the individual thermistors 6*a* and 6*b* and the temperature detection circuit 622, or when energization of the coils to increase the temperature of the heat roller 2 must be interrupted due to any factor such as a paper jam on the non-illustrated image formation portion side, a control command to stop a drive command supplied to the switching element 652 of the drive circuit 651 from the excitation circuit 643 can be inputted to the CPU 642.

It is to be noted that, in the method of supplying a predetermined power to the first and second coils of the fixing roller in the fixing apparatus using the excitation circuit shown in FIGS. 11 and 12, the power is not simultaneously supplied to both the first (central) coil 11*a* and the second (end) coil 11*b* in principle.

That is, in the embodiment according to the present invention, there is adopted a method of supplying a predetermined power to any one of the coils or temporarily stopping supply of the power to any coil. It is to be note that the intensity of the power supplied to the first coil 11*a* is set substantially equal to that of the power supplied to the second coil 11*b* in this embodiment according to the present invention. Moreover, in general terms, when predetermined powers are supplied to the first and second coils 11*a* and 11*b* alternately and the temperature of the roller 2 in the vicinity of the center of the center thereof reaches a set target temperature, the power supply to all the coils may be temporarily stopped until the temperature of the roller 2 in the vicinity thereof becomes lower than the set target temperature by a predetermined value. On the contrary, the power may be supplied to only one coil for a fixed time, e.g., up to approximately 15 seconds.

It is needless to say that the power can be simultaneously supplied to all the coils, but a power detection mechanism which detects the power outputted from each coil must be provided to each coil in such a case. As described above, therefore, it is preferable to supply the power to only one of the coils. Incidentally, when a difference between the powers supplied to the individual coils, i.e., the drive frequencies becomes larger than a predetermined value, not only the above-described interference noise is generated, but also voltage fluctuations occur in a specific range of the commercial power supply to which the non-detailed copying apparatus is connected, which results in generation of the flicker and the like. Therefore, when switching the coils to which the power is supplied, it is preferable to set the powers supplied to the respective coils substantially equal.

Description will now be given as to a method of increasing a temperature of the heat roller by selecting a coil to which a predetermined power is supplied.

As already described above, in the regular heating that the entire area of the heat roller 2 in the longitudinal direction is substantially evenly heated, the switching circuit 31 described in connection with FIG. 11 supplies a high-frequency output (the current and the voltage) with a predetermined frequency to each of the coils 11*a* and 11*b*. In this case, the high-frequency output with the first resonance frequency $f_1$ or the third frequency $f_{12}$ suitable for generating a magnetic flux from the first coil 11*a* and the high-frequency output with the second resonance frequency $f_2$ or the third frequency $f_{12}$ suitable for generating a magnetic flux from the second coil 11*b* are alternately inputted to the individual coils at predetermined time intervals.

Incidentally, when the resonance frequencies of all the coils are different frequencies and the power with the third frequency $f_{12}$ with which all the coils (hardly generate a rated magnetic flux but) can produce the magnetic flux with a predetermined intensity is simultaneously inputted to all the coils, alternate input (alternate drive) of the power to each coil as described above can prevent the illumination light radiated from the discharge lamp illumination equipment provided in close proximity from flickering (generation of the flicker).

In addition, the resonance frequency of the coil corresponding to the part of the roller which can be a temperature increasing target can be associated with the resonance frequency of the coil corresponding to the remaining part of the roller, and the power supplied to the coil used to increase the temperature can cause the remaining coil to output the magnetic flux with a predetermined intensity. For example, by selecting an arbitrary frequency in a frequency $f_x$ which is the frequency with which the coils 11*a* and 11*b* shown in FIG. 13 can simultaneously output a predetermined magnetic flux, the output of the coil 11*a* can be set to approximately 70%. Incidentally, in this case, since the output of the coil 11*b* depends on the resonance frequency of itself, it does not necessarily become approximately 30%, but a predetermined output in a range restricted by a maximum value of the input current or the input power can be obtained. On the contrary, the output of the coil 11*b* can be set to approximately 30%, but the output of the coil 11*a* in this case becomes a predetermined output in a range restricted by a maximum value of the input current or the input power. As described above, a temperature difference (temperature ripple) which may be generated in the longitudinal direction of the roller can be reduced by supplying a predetermined power to each of the coils 11*a* and 11*b*.

Figure 14:
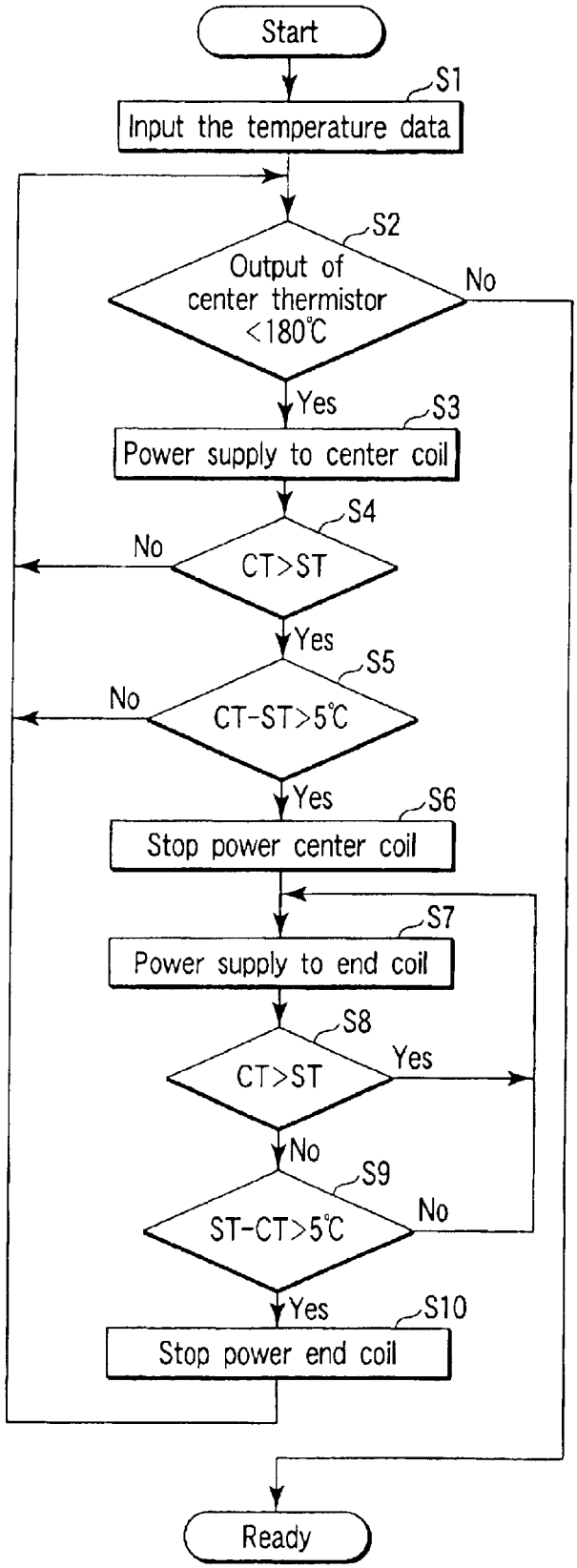
FIG. 14 is a flowchart for illustrating an example of controlling a temperature of the fixing apparatus depicted in FIGS. 11 to 13.

In detail, as shown in FIG. 14, when a non-illustrated power supply switch in the non-detailed copying apparatus is turned on, temperatures in areas of the heat roller 2 opposed to the respective thermistors 6*a* and 6*b* are detected by the first and second thermistors (temperature detection mechanisms) 6*a* and 6*b*. That is, the thermistor 6*a* detects a temperature of the roller 2 in the vicinity of the substantial center in the longitudinal direction, and the thermistor 6*b* detects a temperature of the ends of the roller 2 in the longitudinal direction, respectively. Detection outputs fed from the respective thermistors 6*a* and 6*b* are inputted to the temperature detection circuit 622 (S1).

Although temperature data CT indicative of a temperature of the roller 2 in the vicinity of the center outputted from the temperature detection circuit 622 and temperature data ST indicative of a temperature at the ends of the roller 2 are outputted to the CPU 642 and the main control circuit 151 (shown in FIG. 11) of the non-illustrated image forming section 103, the temperature data CT is first compared with the set target temperature read from the non-illustrated memory in the CPU 642. It is to be noted that the set target temperature is, e.g., 180° C. (S2).

When the temperature data CT is lower than the set target temperature (S2—YES), the first resonance frequency $f_1$ is directed from the CPU 642 to the excitation circuit 643. Therefore, the power with the frequency $f_1$ is supplied to the first coil 11*a* (S3).

On the other hand, when the temperature of the roller 2 at the center has already reached the set target temperature (S2—NO), supply of the power to the coil 11*a* which will be described later is stopped, and the processing enters a ready mode (end of the warm-up mode).

Then, whether the temperature in the vicinity of the roller 2 (temperature data CT) is higher than the temperature at the both ends of the roller 2 (temperature data ST) is checked (S4). Incidentally, when it is detected that the temperature in the vicinity of the center of the roller 2 is lower than the temperature at the ends at the step S4 (S4—NO), supply of the power to the first coil 11*a* , i.e., heating of the roller center is continued, until the temperature at the roller center is higher than the temperature of the end of the roller.

When it is detected that the temperature at the center of the roller 2 is higher than the temperature at the ends of the roller 2 (S4—YES), a temperature difference "CT−ST" of the roller 2 in the longitudinal direction is detected. Furthermore, the temperature difference "CT−ST" is set to, e.g., 5° C. (S5).

At the step S5, when it is detected that a difference between the temperature in the vicinity of the center of the roller 2 and the temperature at the ends of the roller 2 is not less than 5° C. (S5—YES), the power supplied to the coil 11*a* is interrupted by an oscillation stop command from the CPU 642 to the excitation circuit 643 (S6).

On the contrary, at the step S5, when it is detected that a difference between the temperature at the center of the roller 2 and the temperature at the ends of the roller 2 is less than 5° C. (S5—NO), the power with the first resonance frequency $f_1$ is continuously supplied to the coil 11*a* (the center of the roller 2 is heated).

At the step S6, when supply of the power to the first coil 11*a* is stopped, the second resonance frequency $f_2$ with which the power substantially equal to the power supplied to the first coil 11*a* can be outputted to the second coil 11*b* is directed from the CPU 642 to the excitation circuit 643.

As a result, the power with the frequency $f_2$ is supplied to the second coil 11*b* (S7).

Thereafter, whether the temperature at the ends of the roller 2 (temperature data ST) is higher than the temperature in the vicinity of the center of the roller 2 (temperature data CT) is checked (S8).

When it is detected that the temperature at the ends of the roller 2 is higher than the temperature in the vicinity of the center at the step S8 (S8—YES), whether the temperature difference "ST−CT" between them is higher than, e.g., 5° C. is checked (S9).

When it is detected that the temperature at the ends of the roller 2 is higher than the temperature at the center at the step S9 (S9—YES), the CPU 42 gives the second resonance frequency $f_2$ (S10). Therefore, when the temperature at the center of the roller 2 reaches 180° C. and a difference between the temperature at the ends of the roller 2 and the temperature at the center of the roller 2 exceeds 5° C., supply of the power to all the coils is temporarily stopped.

Incidentally, when it is detected that the temperature at the ends of the roller 2 is lower than the temperature at the center at the step S8 (S8—NO) and when the temperature difference "ST−CT" is less than 5° C. at the step S8 (S9—NO), it is needless to say that the power with the second resonance frequency $f_2$ is continuously supplied to the coil 11*b*.

It is to be noted that, in the drive method shown in FIG. 14, the power is first supplied to the first coil 11*a* which increases the temperature at the center of the roller 2 in the longitudinal direction, power supply to the central coil 11*a* is stopped when the temperature at the center of the roller 2 is increased to be higher by a predetermined value than the temperate at the ends of the roller 2 detected at a position opposed to the second coil 11*b* which increases the temperature at the ends of the roller 2 in the longitudinal direction, and a predetermined power is supplied to the end coil 11*b*. Moreover, when the temperature in the vicinity of the center of the roller 2 in the longitudinal direction reaches 180° C., energization of all the coils is temporarily interrupted without checking the temperature at the ends.

By repeating such a control, the temperatures at the center of the roller 2 and at the ends of the roller 2 can be uniformized. It is to be noted that the above-described drive method is characterized in that the temperature of the roller 2 can be increased to substantially the same temperature (180° C.) even if supply of the power is controlled based on only a detection result from the thermistor 6*a* provided in the vicinity of the center of the roller 2 or even if supply of the power is controlled based on only a detection result from the thermistor 6*b* provided at the end portion of the roller 2.

In this case, the temperature at the end ends of the roller 2 may temporarily exceed 180° C. in some cases, but a temperature difference between the temperature CT at the center of the roller and the temperature ST at the roller ends is managed so as not to exceed 5° C., and hence the temperature at a specific part of the roller is not excessively increased.

It is needless to add that outputs of the first reference frequency $f_1$ and the second resonance frequency $f_2$, which are outputted so as to enable an increase in temperature of each of the coils 11*a* and 11*b*, from the excitation circuit 643 are stopped when the temperatures at both the center and the ends of the roller 2 have reached the set temperature, and hence the temperature in the entire area of the roller 2 is maintained substantially evenly.

Figure 15:
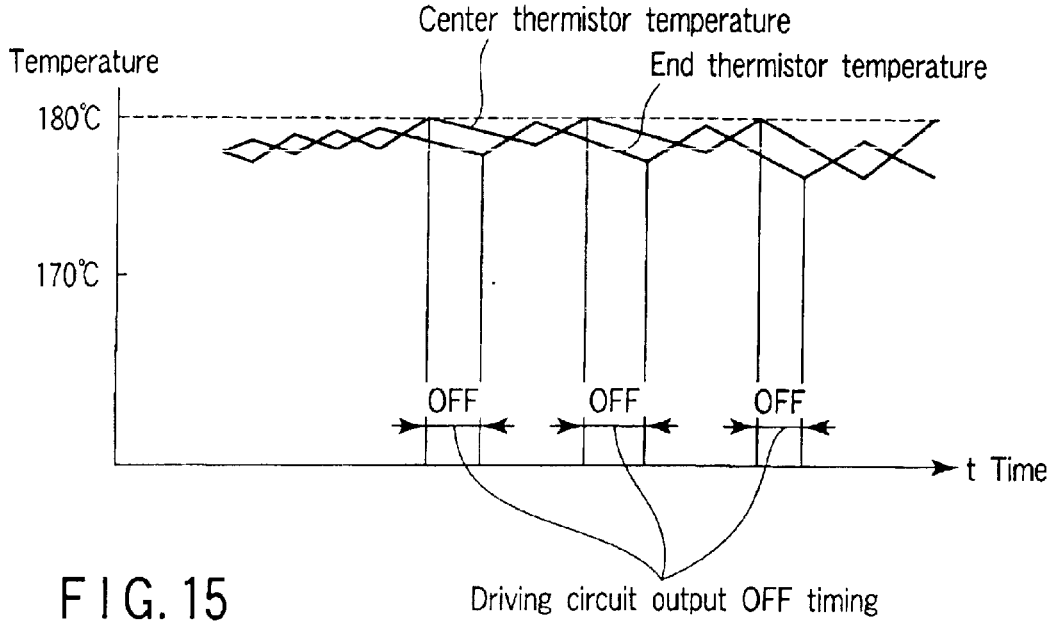
FIG. 15 is a schematic view for illustrating a change in temperature of the heat roller when using an example of the temperature control different from the method of controlling the temperature depicted in FIG. 14.
Figure 16:
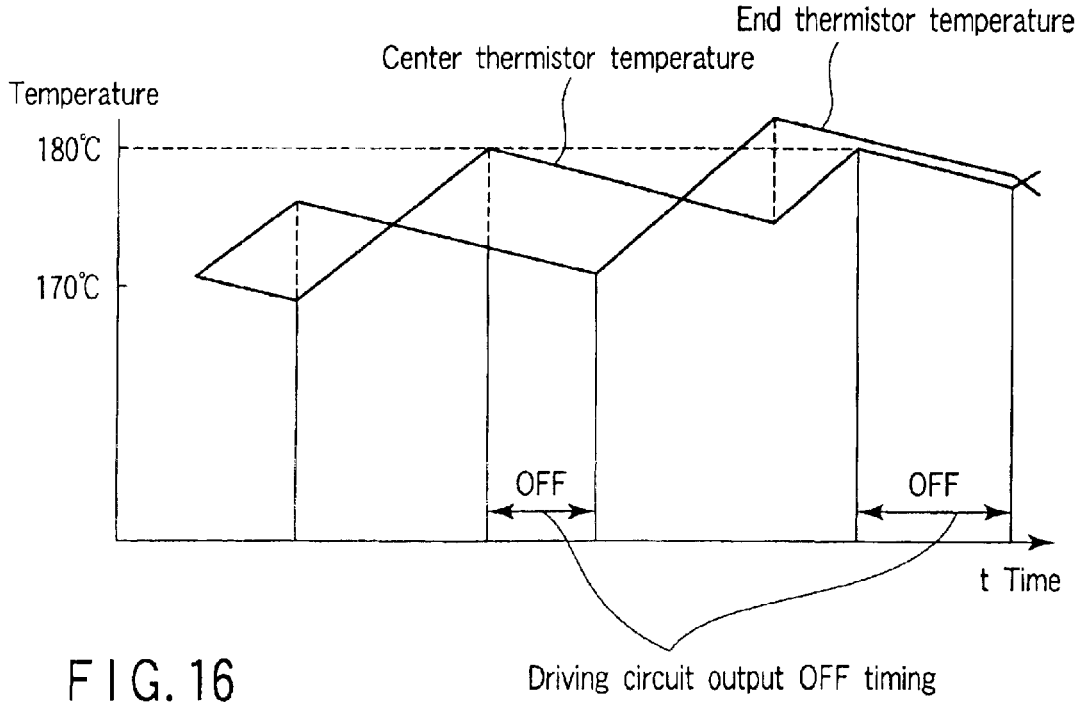
FIG. 16 is a schematic view for illustrating a change in temperature of the heat roller when using an example of the temperature control different from the method of controlling the temperature of the heat roller depicted in FIGS. 14 and 15.

FIGS. 15 and 16 are schematic views for illustrating an example that the switching timing of switching the coil to which the power is supplied, which has been described in connection with FIG. 14, is adapted to the operating state of the copying apparatus.

In the drive method shown in FIG. 15, when a temperature difference obtained from the temperature data CT at the enter of the roller 2 and the temperature data ST at the ends of the roller 2 outputted from the temperature detection circuit 622 has reached 3° C., an instruction is issued in such a manner that a frequency directed from the CPU 642 to the excitation circuit 643 is switched to any of the first resonance frequency $f_1$ and the second resonance frequency $f_2$. That is, energization of all the coils is stopped when the temperature at the center of the roller 2 has reached 180° C., and a predetermined power is again supplied to any coil when a temperature difference between the temperature at the center of the roller 2 and the temperature at the ends of the roller 2 has reached 3° C. According to this method, even if a temperature distribution ripple (irregularities in temperature) has occurred in the longitudinal direction of the roller 2, its level can be suppressed to be small.

It is to be noted that this driving method is suitable to, e.g., the case that the temperature is increased to a set target temperature when a non-illustrated power supply switch of the copying apparatus is turned on (warm-up operation) or the case that the paper is passed between the roller 2 and the roller 3 like the image forming operation by the copying apparatus (paper feed operation).

For example, in the paper feed operation, i.e., image formation or in the warm-up operation after turning on the power supply, since the large energy is required in order to maintain the temperature of the heat roller 2 or increase the temperature of the roller 2 to a predetermined temperature, a large quantity of power close to the upper limit of the power which can be inputted is needed.

Therefore, even if the control value (temperature difference) is set to 3° C., since either the power with the first resonance frequency $f_1$ or the power with the second resonance frequency $f_2$ is constantly supplied to each of the coil 11*a* and the coil 11*b* , the power inputted through the rectification circuit 731 is hardly interrupted. Therefore, the illumination light from the fluorescent lamp (illumination) in the same circuit hardly flickers (generation of flicker) because of occurrence of voltage fluctuations in the non-illustrated same commercial power supply circuit to which the non-illustrated copying apparatus is connected.

Further, since a temperature difference in the longitudinal direction of the roller 2 is slightly maintained, there rarely occurs a disadvantage that the fixing property is temporarily decreased.

On the other hand, as apparent from FIG. 15, it is obvious that the coil to which the power is supplied is frequently switched by setting to 3° C. the temperature difference (control value) between the center and the ends of the roller 2 when switching the coil as a target to which the power is supplied.

In this case, the ripple of the temperature distribution of the roller can be reduced and the disadvantage that the fixing property is lowered hardly occurs as described above, but, for example, in the ready mode of waiting for an input for image formation after the temperature at the center of the roller 2 in the longitudinal direction has reached 180° C., it is nothing else that the number of times that the resonance circuit 31 is turned on/off is increased.

In detail, in case of alternately switching the coils to which the power is supplied, i.e., alternately outputting the first resonance frequency $f_1$ and the second resonance frequency $f_2$, when the temperature difference which is the control value for switching is managed at 3° C., input and interruption of the direct-current output supplied after rectification by the rectification circuit 731 are repeated under the condition that the heat of the roller is hardly lowered like the ready mode. In this case, a voltage fluctuation may occur in the commercial power supply circuit to which the copying apparatus is connected, and the flicker may be generated in the fluorescent lamp (illumination) in the same circuit.

Therefore, in, e.g., the ready mode, as shown in FIG. 16, the timing to switch the coils to which the power is supplied, i.e., the control value (temperature difference) is set to 6° C.

As shown in FIG. 16, the timing to alternately output the first resonance frequency $f_1$ and the second resonance frequency $f_2$ is set to 6° C. in terms of the temperature difference between the center and the ends of the roller 2 in the longitudinal direction, for example. In this case, since the time that the power is continuously supplied to the coil to which the power is supplied is prolonged, the temperature distribution ripple itself of the roller is increased.

For example, when the temperature at the center of the roller reaches 180° C. in the state that the power is supplied to the coil 11*a* used to increase the temperature at the center of the roller 2, input of the direct-current voltage from the rectification circuit 731 with respect to each of the coils 11*a* and 11*b* is interrupted. Therefore, the temperature at the ends of the roller is maintained at a lower temperature than the temperature at the center of the roller.

Therefore, when the CPU 42 detects that the temperature difference between the center and the ends of the roller has exceeded 6° C., the power is in turn supplied to the coil 11*b* in order to increase the temperature at the ends of the roller 2.

As described above, according to the control illustrated in FIG. 16, the time that the power is not supplied to any coil is increased as compared with the control example that the temperature difference is small described in connection with FIG. 15. Thus, the number of times of input and interruption of the direct-current output supplied after rectification by the rectification circuit 731 is reduced. That is, even if a voltage fluctuation occurs in the commercial power supply circuit to which the copying apparatus is connected and the flicker is generated in the fluorescent lamp (illumination) in the same circuit, the frequency (number of times) of occurrence of such a case can be suppressed.

It is to be noted that, according to the control illustrated in FIG. 16, the temperature distribution ripple in the longitudinal direction of the roller and the temperature difference between the center and the ends of the roller are both increased as compared with the control mentioned above in connection with FIGS. 14 and 15. However, in the ready mode, since the fixing property does not have to be considered, it is possible to obtain a merit that the flicker is reduced. Furthermore, in a period that the image formation is instructed and the paper P is carried between the roller 2 and the roller 3, it is good enough that the temperature distribution ripple in the longitudinal direction of the roller 2 falls within a fixed range, thereby reducing the power consumption.

As described above, by changing the temperature difference (control value) utilized to set the timing of switching the first resonance frequency $f_1$ and he second resonance frequency $f_2$ with which a predetermined power can be supplied to each of the coils 11*a* and 11*b* in order to increase the temperature of the roller 2 in the fixing apparatus 1 in accordance with the operating state of the copying apparatus, it is possible to suppress generation of the flicker in the illumination light from the fluorescent lamp in the commercial power supply circuit to which the copying apparatus 101 is connected, which is caused due to a voltage fluctuation in the same circuit. Moreover, the magnetic fluxes may be simultaneously generated from all the coils 11*a* and 11*b* by supplying the power with the third resonance frequency $f_{12}$ to the individual coils at the same time.

Although FIGS. 14 to 16 illustrate the example of switching the coil to which the power is to be supplied by monitoring the operating state of the copying apparatus, the timing to switch the coil to which the power is supplied may be changed in accordance with, e.g., a temperature of the roller.

For instance, when both the temperature at the center of the roller 2 and the temperature at the ends of the roller 2 are greatly lower than a set target temperature (e.g., 180° C.), the temperature increasing operation (warm-up operation) different from the image forming operation can be expected, and hence the timing to switch the coil to which the power is supplied may be rough (large temperature difference).

On the other hand, when the temperatures detected by the thermistors 6*a* and 6*b* are temperatures close to the set target temperature, since the fixing operation (image forming operation) can be expected, it is preferable to break up the timing to switch the coil to which the power is supplied, thereby suppressing the temperature distribution ripple in the longitudinal direction of the roller 2.

Figure 17:
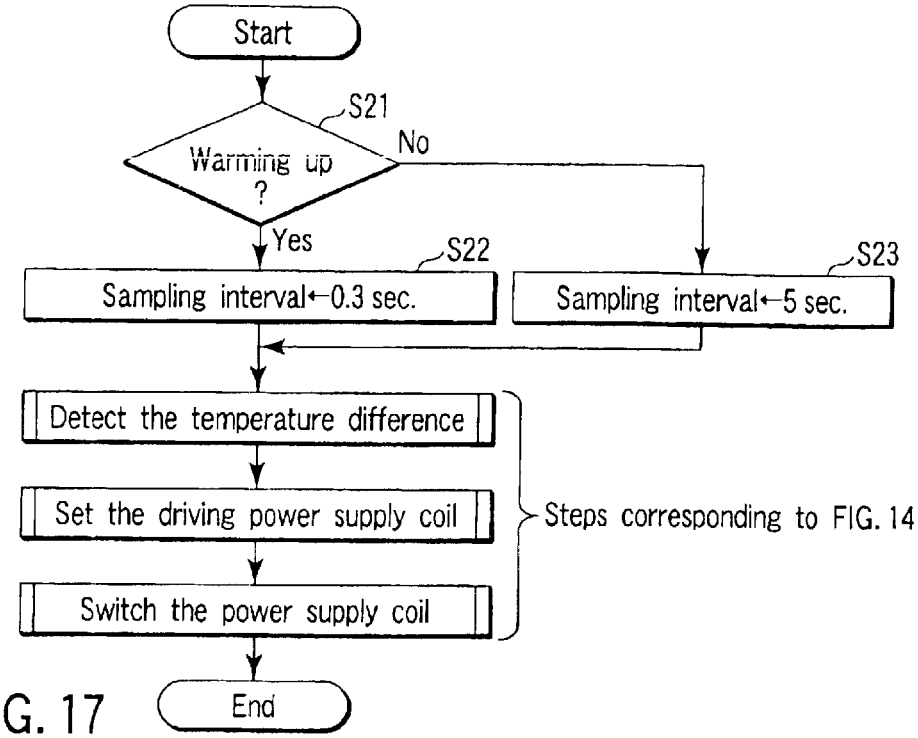
FIG. 17 is a flowchart for illustrating a further example of the temperature control different from the example of controlling the temperature of the heat roller depicted in FIGS. 14 to 16.

FIG. 17 is a schematic view for illustrating an example of the temperature control different from the method of increasing the temperature of the heat roller described in connection with FIGS. 14 to 16. It is to be noted that the temperature control described below in conjunction with FIG. 17 concerns sampling of temperature information utilized when switching the timing of supplying the power with any of the first resonance frequency $f_1$ and the second resonance frequency $f_2$ to each of the coil used to increase the temperature at the center of the roller and the coil used to increase the temperature at the ends of the roller in order to increase the temperature of the roller which has been already explained with reference to FIG. 14.

As shown in FIG. 17, a judgment is first made whether the operating state of the copying apparatus is the point in time that the non-illustrated power supply switch in the non-detailed copying apparatus is turned on, or the standby state that a predetermined time has elapsed after turning on the power supply switch and the initial operation has been terminated, or the image forming state that the image formation is instructed and the paper is carried between the heat roller and the pressure roller, and others (S21). It is to be noted that the image forming mode can be separated into a fixing period that the paper exists between the heat roller 2 and the pressure roller 3 and a paper period (interval) that the paper does not exist between the rollers. However, distinguishing whether the power is supplied to the coil in order to increase the temperature of the heat roller 2 can suffice, and hence whether the paper exists between the rollers in the image forming mode is no object in this example. Moreover, although not explained in detail, the ready mode includes an energy saving mode and the like to maintain the temperature of the roller at a temperature lower than that in the normal ready mode.

If the operating state of the copying apparatus checked at the step S21 is the image forming operation or the warm-up operation between turn-on of the non-illustrated power supply to the ready mode or the image formation enabling mode (S21—YES), an interval that the temperature information outputted from the first and second thermistors 6*a* and 6*b*, which is inputted through the temperature detection circuit 622, is fetched (sampled) to the CPU 642 of the excitation unit 621 and the main control circuit 151 of the image forming section 103 (shown in FIG. 11) is set to, e.g., 0.3 second (S22). Therefore, power supply (or drive stop) to each coil used to increase the temperature at either the center or the ends of the roller 2 and the timing of switching the first resonance frequency $f_1$ and the second resonance frequency $f_2$ are set based on the temperature difference in the longitudinal direction of the roller 2 detected every 0.3 second. As a result, the temperature difference between the temperature at the center of the roller and the temperature at the ends of the roller is uniformized to a level close to almost no difference when the paper is not carried. It is to be noted that the interval that the temperature information is sampled (fetched) may be set to a predetermined time, e.g., approximately 0.5 second to 1 second based on the characteristic of the coils (a wire diameter, a radius of winding and the number of times of turns, presence/absence of a core material, and others) or the power supplied to the coil.

On the other hand, if the operating state of the copying apparatus checked at the step S21 is the ready mode which does not belong to any of the image forming operation or the warm-up operation (S21—NO), the interval that the temperature information outputted from the first and second thermistors 6*a* and 6*b*, which is inputted through the temperature detection circuit 622, is fetched to the CPU 642 (main control circuit 151) is set to, e.g., 5 seconds (S23). In this case, although the temperature difference between the temperature at the center of the roller and the temperature at the ends of the roller becomes larger as compared with the case the temperature difference is detected at the short intervals described at the step S22, the operation is in the ready mode, and hence the fixing property does not have to be taken into consideration for the reason explained in connection with FIG. 16. Therefore, there is a merit that the flicker is reduced.

In addition, although the temperature distribution ripple of the roller is also increased, it is good enough that the ripple falls within a fixed range in a period that the image formation is instructed and the paper is then carried between the roller 2 and the roller 3, thereby reducing the power consumption. It is to be noted that the interval (time) that the temperature information is sampled is set to an extent that the temperature distribution in the longitudinal direction of the roller 2 can be restored to the temperature difference which does not affect the fixing property in a period that the image formation is instructed and then the paper is carried between the roller 2 and the roller 2, based on various parameter as typified by characteristics of the coils (a wire diameter, a radius of winding and the number of times of turns, presence/absence of a core material, and others), a material or a thickness of the roller 2, a maximum value of the power which can be supplied to the coil, and the like.

As described above, changing the timing to sample the temperature information from the first and second thermistors 6*a* and 6*b* shown in FIG. 17 is nothing less than changing the timing to supply the power with the first resonance frequency $f_1$ or the second resonance frequency $f_2$ to each coil.

When a large quantity of heat is required in, e.g., the image forming operation or the warm-up operation, shortening the interval to detect the temperature difference in the longitudinal direction of the roller can reduce the ripple generated in the temperature distribution in the longitudinal direction of the roller. That is, since the temperature distribution is uniformized in the entire area of the roller in the longitudinal direction, thereby improving the fixing property.

On the other hand, in the ready mode or the energy saving mode, even if an output fluctuates due to temporal stop of energization of the coils and the flicker is generated in the illumination in the same circuit, allowing the temperature distribution in the longitudinal direction of the roller to include the ripple can reduce a frequency (number of times) of occurrence of such a disadvantage.

It is to be noted that the shortest time (interval) of the timing to detect the temperature difference is set to 0.3 second because the time required for the output from the coil to which the power is supplied to be stabilized (time required for the output from the coil to reach a target output) after supply of the power to the coil to which the power should be supplied is approximately 0.5 second. That is, when the coil which is a target of power supply is switched in a period shorter than 0.5 second, the output from the coil may not reach the target output, and hence switching the coil to which the power is supplied in an extremely short period must be avoided. Additionally, 0.2 to 0.3 second is required in order to obtain the temperature difference from the temperatures detected by the first and second thermistors 6*a* and 6*b* and feed back the result to the excitation circuit 43. Based on this, in the invention according to this application, the shortest interval (period) of the timing to detect the temperature difference is set to 0.3 second.

It is to be noted that, in FIG. 17, although description has been given as to the example of switching the coil to which the power is to be supplied in association with the operating state of the non-detailed copying apparatus, the timing to switch the coil to which the power is to be supplied may be changed in accordance with, a temperature of the roller.

For example, when both the temperature at the center of the roller 2 and the temperature at the ends of the roller 2 are greatly lower than the set target temperature (180° C. in the invention according to the present application), since the warm-up operation can be expected, the timing to switch the coil to which the power is supplied may be rough.

On the other hand, when the temperatures detected by the first and second thermistors 6*a* and 6*b* are temperatures close to the set target temperature, the fixing operation can be expected, and hence it is preferable to break up the timing to switch the coil to which the power is supplied by changing over the first resonance frequency $f_1$ and the second resonance frequency $f_2$, thereby suppressing the temperature distribution ripple in the longitudinal direction of the roller 2.

Figure 18:
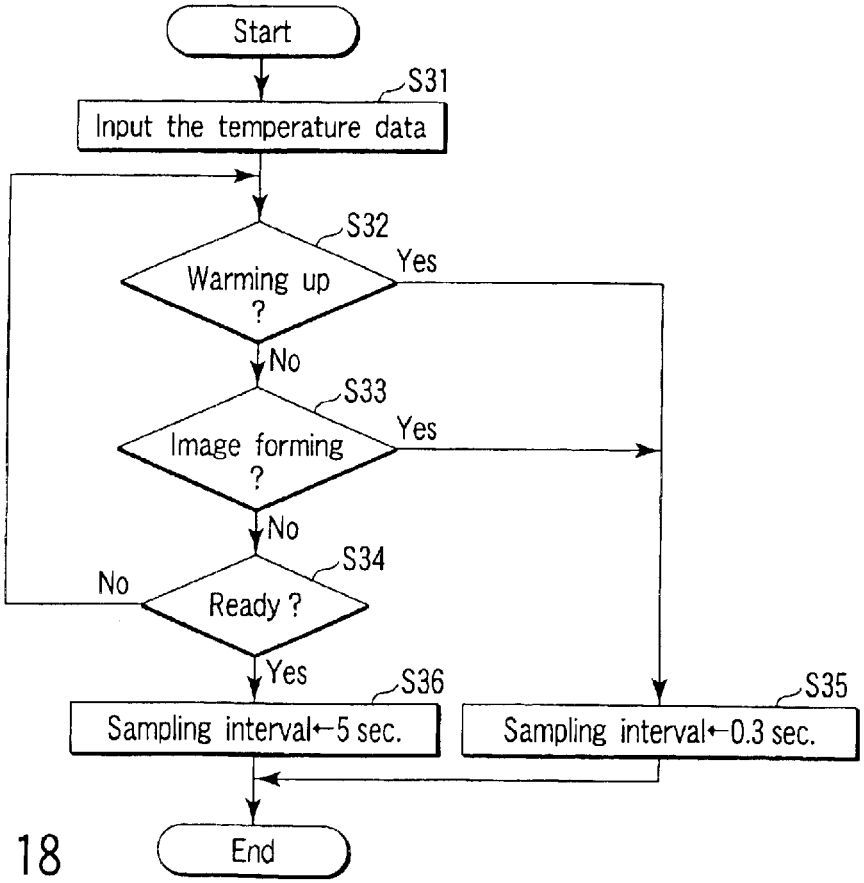
FIG. 18 is a flowchart for illustrating another example of the temperature control different from the example of controlling the temperature of the heat roller depicted in FIGS. 14 to 17.

FIG. 18 is a schematic view for illustrating one modification of the example of increasing the temperature of the heat roller described above in connection with FIG. 17.

As shown in FIG. 18, when the operating state of the copying apparatus corresponds to, e.g., any of the point in time that the non-illustrated power supply switch of the copying apparatus is turned on, the warm-up state that the temperature of the heat roller 2 is increased to a predetermined temperature after turning on the power supply switch and the initial operation is then terminated, the image forming operation that the image formation is instructed and the paper is carried between the heat roller and the pressure roller, and the standby state that the warm-up operation or the image forming operation is terminated but the subsequent image formation is not instructed, the temperatures at the center and the ends of the roller 2 detected by the first and second thermistors 6*a* and 6*b* are continuously inputted to the CPU 642 and the main control circuit 151 of the non-detailed image forming section as temperature information at predetermined time intervals (S31). It is to be noted that the timing that the outputs from the respective thermistors 6*a* and 6*b* are fetched to each of the CPU 642 and the main control circuit 151 is approximately 0.1 second (100 msec), for example.

When the temperature information is continuously inputted to the CPU 642 and the main control circuit 151 at the step S31, the main control circuit 151 checks the operating state of the copying apparatus, i.e., that the copying apparatus is currently in the warm-up state (S32), the image forming state (S33) or the standby state (S34). It is to be noted that the order of checking the respective operating states is not of course restricted to the above-described order of the steps.

When it is detected that the copying apparatus is currently in the warm-up state at the step S32 (S32—YES), the main control circuit 151 informs the CPU 642 of the excitation unit 621 that the sampling interval to detect the temperature difference in order to output the control signal is 0.3 second for the purpose of outputting any of the first resonance frequency $f_1$ and the second resonance frequency $f_2$ to the excitation circuit 643 (S35).

When it is detected that the copying apparatus is currently in the image forming operation at the step S33 (S33—YES), the main control circuit 151 informs the CPU 642 of the excitation unit 621 that the sampling interval to detect the temperature difference used to output the control signal is 0.3 second for the purpose of outputting any of the first resonance frequency $f_1$ and the second resonance frequency $f_2$ to the excitation circuit 643 like the step S32—YES (S35).

When it is detected that the copying apparatus is in the ready mode (non-image-forming state) at a step S34 (S34—YES), the main control circuit 151 informs the CPU 642 that the sampling interval to detect the temperature difference is 5 seconds (S36). Furthermore, when the copying apparatus is in the non-warm-up mode (S32—NO) or when the copying apparatus is not in the image forming mode (S33—NO), the main control circuit 151 likewise informs the CPU 42 that the sampling interval to detect the temperature difference is 5 seconds (S36).

As described above, the control illustrated in FIG. 18 is characterized in that the temperature information from the first and second thermistors 6*a* and 6*b* is sampled and the timing to obtain the temperature difference from the temperature information is then changed in accordance with the operating state of the copying apparatus. It is to be noted that changing the timing to obtain the temperature difference from the temperature information is nothing less than varying the timing to supply the power to the coil.

For example, when a quantity of heat is required in, e.g., the image forming operation or the warm-up operation, shortening the timing to detect the temperature difference can reduce the ripple generated in the temperature distribution in the longitudinal direction of the roller. That is, since the temperature in the longitudinal direction of the roller can be uniformized, the fixing property can be improved.

On the other hand, in the ready mode or the energy saving mode, the temperature distribution in the longitudinal direction of the roller is allowed to include the ripple by increasing the interval to detect the temperature difference. Further, even if the flicker is generated in the illumination in the same circuit because of a fluctuation in output due to temporal stop of energization of the coils, a frequency of occurrence of such a disadvantage can be reduced. Furthermore, the flicker can be prevented from being generated by supplying the power with the third resonance frequency $f_{12}$ to all the coils 11*a* and 11*b* at the same time and causing the individual coils to simultaneously produce the magnetic fluxes.

It is to be noted that the shortest time (interval) of the timing to detect the temperature difference is set to 0.3 second because the time of approximately 0.5 second is required until the output from the coil to which the power is supplied is stabilized (until the output from the coil reaches a target output) after the point in time that the power is supplied to the coil to which the power should be supplied. That is, if the coil as a target to which the power is supplied is switched in a period shorter than 0.5 second, the output from the coil may not reach the target output in some cases. Therefore, switching the coil to which the power is supplied in an extremely short period must be avoided.

It is to be noted that FIG. 18 illustrates the example of switching the coil to which the power should be supplied in association with the operating state of the copying apparatus but the coil to which the power is supplied, i.e., the timing to switch the first resonance frequency $f_1$ and the second resonance frequency $f_2$ may be changed in accordance with, e.g., the temperature of the roller.

For example, when both the temperature at the center of the roller 2 and the temperature at the ends of the roller 2 are greatly lower than the set target temperature (180° C. in the present invention), the warm-up operation can be expected. That is, even if the timing to obtain the temperature difference in the longitudinal direction of the roller from the temperature information outputted from the two thermistors is extended, the possibility that a problem occurs in the fixing property is low.

On the contrary, when the temperatures detected by the first and second thermistors 6*a* and 6*b* are temperatures close to the set target temperature, it is expected that the copying apparatus is performing the fixing operation. Therefore, it is preferable to shorten the interval to detect the temperature difference in order to switch the coil to which the power is supplied and prevent the temperature distribution in the longitudinal direction of the roller 2 from including the ripple.

Figure 19:
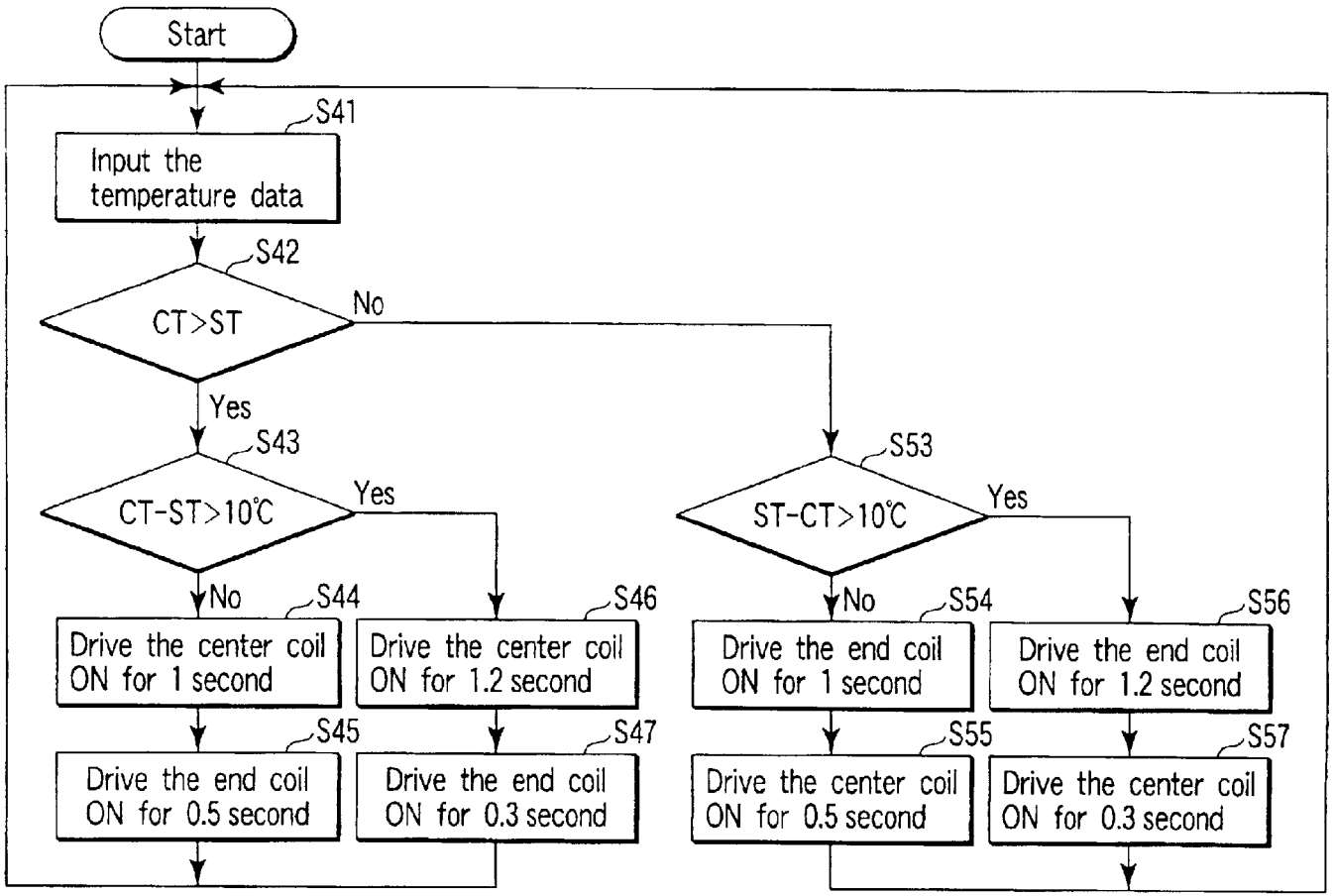
FIG. 19 is a flowchart for illustrating still another example of the temperature control different from the example of controlling the temperature of the heat roller depicted in FIGS. 14 to 18.

FIG. 19 is a schematic view for illustrating yet another example of the temperature control of the method of increasing the temperature of the heat roller described with reference to FIGS. 14 to 16. It is to be noted that the temperature control over the roller 2 shown in FIG. 19 is mainly applied to the image forming operation or the warm-up operation until the temperature of the roller 2 reaches the set target temperature after the power supply is turned on. In addition, in this example, it is determined that a power with a predetermined intensity is alternately supplied for the same time to each of the coil 11*a* used to increase the temperature at the center of the roller 2 and the coil 11*b* used to increase the temperature at the ends of the roller 2. At this moment, the time which is a sum total of the times that power is supplied to each of the coils 11*a* and 11*b* is set to be equal to the timing (interval) to detect the temperature difference between the temperature at the center of the roller 2 and the time at the ends of the same.

As shown in FIG. 19, in the warm-up operation until the temperature of the roller 2 reaches the set target temperature and in the image forming operation, to the CPU 642 is inputted the temperature information outputted from the first and second thermistors 6*a* and 6*b* with the timing described above with reference to FIG. 14 (S41).

Then, in the CPU 642, the temperature data CT indicative of the temperature in the vicinity of the center of the roller is compared with the temperature data ST indicative of the temperature at the ends of the roller (S42).

At the step S42, if it is detected that the temperature ST at the ends of the roller is higher than the temperature CT at the center of the roller (S42—NO), whether the temperature ST at the ends of the roller is higher than the temperature CT at the center of the roller by, e.g., 10° C. or above is checked (S43).

If the temperature ST at the ends of the roller is higher than the temperature CT at the center of the roller by 10° C. or above at the step S43 (S43—YES), the time during which the power with the first resonance frequency $f_1$ is supplied to the central coil 11*a* is set to, e.g., 1.2 second, and the time during which the power with the second resonance frequency $f_2$ is supplied to the end coil 11*b* is set to, e.g., 0.3 second, respectively (S46, S47). On the other hand, if the temperature ST at the ends of the roller is higher than the temperature CT at the center of the roller but a difference between those temperatures is less than 10° C. (S43—NO), the time during which the power with the first resonance frequency $f_1$ is supplied to the coil 11*a* is set to, e.g., 1 second, and the time during which the power with the second resonance frequency $f_2$ is supplied to the coil 11*b* is set to, e.g., 0.5 second, respectively (S44, S45).

On the other hand, when it is detected that the temperature CT at the center of the roller is higher than the temperature ST at the ends of the roller at the step S42 (S42—YES), whether the temperature ST at the ends of the roller is higher than the temperature CT at the center of the roller by, e.g., 10° C. or above is checked (S53).

If the temperature CT at the center of the roller is higher than the temperature ST at the ends of the roller by 10° C. or above at the step S53 (S53—YES), the time during which the power with the second resonance frequency $f_2$ is supplied to the coil 11*b* is set to, e.g., 1.2 second, and the time during which the power with the first resonance frequency $f_1$ is supplied to the coil 11*a* is set to, e.g., 0.3 second, respectively (S54, S55).

If the temperature CT at the center of the roller is higher than the temperature ST at the ends of the roller but a difference between those temperatures is less than 10° C. at the step S53 (S53—NO), the time during which the power with the second resonance frequency $f_2$ is supplied to the coil 11*b* used to increase the temperature at the ends of the roller is set to, e.g., 1 second, and the time during which the power with the first resonance frequency $f_1$ is supplied to the coil 11*a* used to increase the temperature at the center of the roller is set to, e.g., 0.5 second, respectively (S56, S57).

In detail, in the temperature control over the roller described above in connection with FIGS. 14 to 18, when the timing (period) to detect the temperature difference from the temperature at the center of the roller an the temperature at the ends of the roller is, e.g., 1.5 second, the power is supplied to the coil with the lower detected temperature, and the power is supplied to the same coil in the period (interval) to detect the temperature difference. Therefore, the temperature difference in the longitudinal direction of the roller becomes larger as the timing to switch the coil to which the power is supplied is longer. On the contrary, as already described above, shortening the interval to switch the coil to which the power is supplied is effective in order to reduce the temperature difference in the longitudinal direction of the roller.

Based on this, in supply of the power to the coil illustrated in FIG. 19, although the power is supplied to the coil with the lower detected temperature, the time for supply is set to be shorter than the timing to detect the temperature difference. For example, as explained at the steps S44 and S45, when the interval to detect the temperature difference is 1.5 second, it is characterized that the power is supplied to the coil 11*a* used to increase the temperature at the center for 1 second and the power is supplied to the coil 11*b* to increase the temperature at the ends in the remaining 0.5 second.

As described above, the time in which a predetermined power is continuously supplied to, e.g., any of the coil 11*a* used to increase the temperature at the center of the roller 2 and the coil 11*b* used to increase the temperature at the ends of the roller 2 is the interval (1 second in the above example) shorter than 1.5 second which is the period to detect the temperature difference, thereby hastening the switching timing. Therefore, the temperature difference in the longitudinal direction of the roller 2 can be reduced.

It is to be noted that the interval to detect the temperature difference is 1.5 second and the times in which a predetermined power is supplied to the respective coils 11*a* and 11*b* are 1.0 second and 0.5 second in the above example, but a ratio of the times in which the power is supplied to the respective coils is changed if the temperature difference between the center of the roller 2 and the ends of the roller 2 is large. Additionally, the interval to detect the temperature difference and the ratio of power supply relative to the coil 11*a* and the coil 11*b* in that interval can be changed by using, e.g., a non-illustrated predetermined input key of an operation panel 141 such as a copy magnification set key in the service mode by a service personnel. Further, if the power supply ratio can be inputted to the main control circuit 151, it is possible to utilize any method and structure which can be carried out as the input method (conformation).

In cases where the temperature difference exceeds, e.g., 10° C., when the interval to detect the temperature difference is 1.5 second as described at the steps S46 and S47, the power is supplied to the coil 11*a* used to increase the temperature at the center for 1.2 second and the power is supplied to the coil 11*b* used to increase the temperature at the ends for the remaining 0.3 second. Incidentally, in case of switching the time in which the power is supplied to the respective coils 11*a* and 11*b* , this switching is carried out only when the temperature difference detected at the step S43 exceeds 10° C.

Incidentally, in the standby state or the energy saving mode standby state, the timing to switch the power supplied to each of the coils 11*a* and 11*b* is changed to, e.g., 2 second with respect to the coil opposed to a position where the temperature of the roller 2 is low and 1 second with respect to the remaining coil. Furthermore, when the temperature exceeds a predetermined temperature, supply of the power to each coil is temporarily stopped like the other embodiments mentioned above.

Moreover, supplying the power with the third resonance frequency $f_{12}$ to all the coils 11*a* and 11*b* at the same time and causing the individual coils to simultaneously produce the magnetic fluxes can restrict a quantity of the magnetic flux generated from each coil to a predetermined quantity and increase the temperate in the entire area of the roller 2.

According to the method mentioned above, the switching interval can be extended without changing the ratio (switching timing) of supply of the power to each coil. Therefore, the number of times that supply of the power to each switching circuit is turned on/off by the drive circuit (number of times that the output from the power supply circuit is connected to the switching circuit by the drive circuit) is reduced, thereby suppressing the voltage fluctuations. That is, this is useful when the flicker and the like is generated (or may be possibly generated). It is to be noted that the time in which the power is continuously supplied to one coil (opposed to the side with the higher temperature) is reduced and hence the temperature distribution in the longitudinal direction of the roller 2 can be uniformized. Moreover, the embodiment explained in connection with FIG. 19 is particularly useful when, e.g., the timing-to detect the temperature difference is relatively slow because of a constant of the temperature detection circuit and the like.

Incidentally, as to switching of supply of the power illustrated in FIG. 19, description has been given as to the example that the timing to supply the power to each coil is switched in accordance with the operation mode of the copying apparatus, but it may be changed in accordance with the temperature of the roller 2. For example, when the temperature of the roller is greatly lower than the set target temperature (e.g., 180° C.), the time itself in which the power is supplied to an arbitrary coil may be prolonged. On the contrary, after the thermistors 6*a* and 6*b* detect that the temperature of the roller is increased to a temperature in the vicinity of the set target temperature, the switching timing of supply of a predetermined power to each coil may be reduced.

It is to be noted that the power supply switching control illustrated in FIG. 19 and the control shown in FIG. 16 or FIG. 17 may be combined. Moreover, it is needless to say that the above-described control method may be switched in order to enable the operation in accordance with the operation mode of the copying apparatus.

Figure 20:
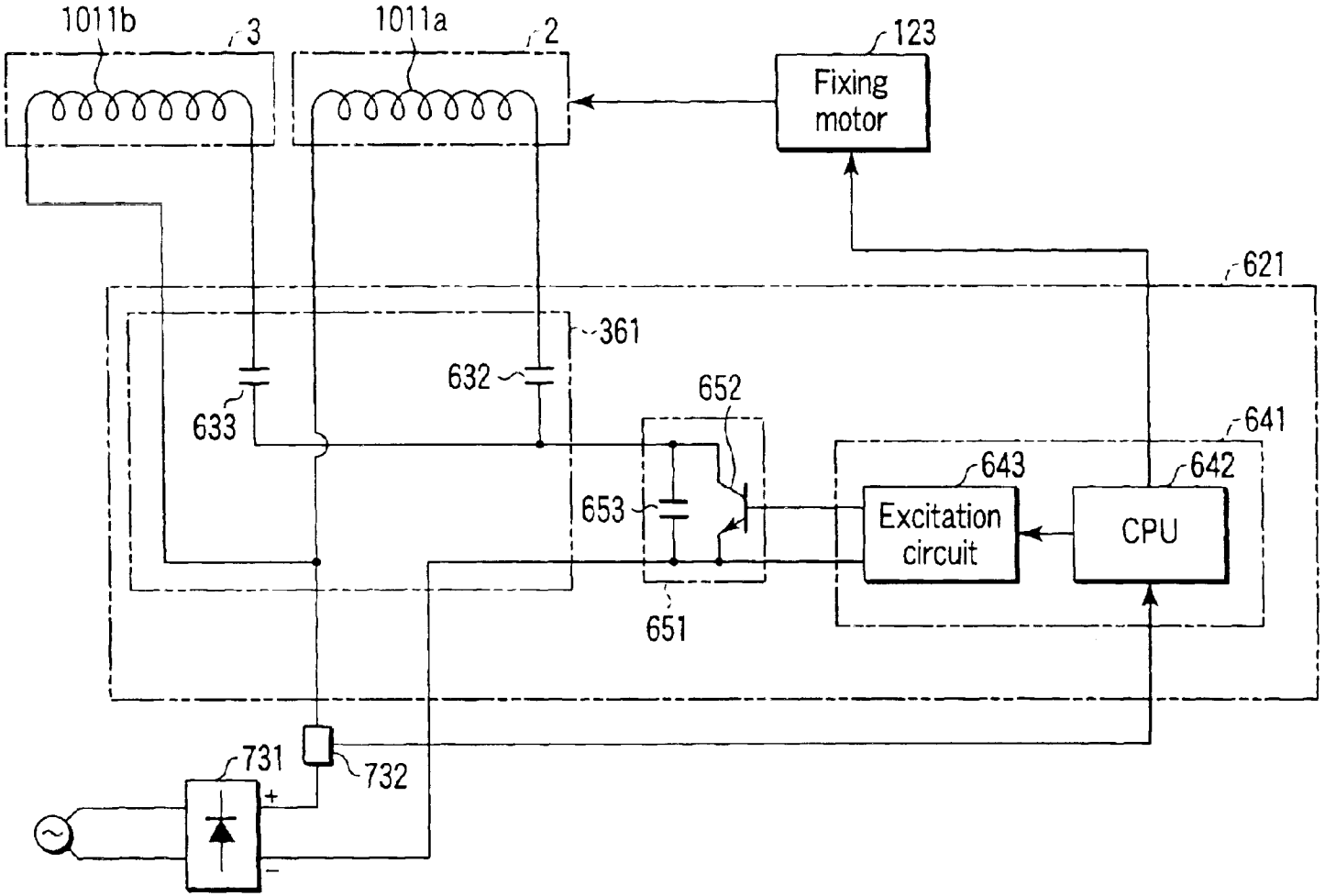
FIG. 20 is a schematic view for illustrating an example of a control mechanism which can supply a power with a predetermined frequency to each excitation coil of a fixing apparatus in which the excitation coils are incorporated in all the rollers different from the fixing apparatus depicted in FIGS. 1 to 10.

FIG. 20 illustrates an example of a control mechanism which can supply the power with a predetermined frequency to each excitation coil in the fixing apparatus in which the excitation coils are incorporated in all the rollers, which is different from the fixing apparatus shown in FIGS. 1 and 10. It is to be noted that like reference numerals denote structures equal or similar to those in the excitation unit explained above in conjunction with FIGS. 11 and 12, thereby eliminating the detailed description.

Although not explained in detail, description will be given as to an example that first and second coils 1011*a* and 1011*b* are respectively incorporated in the heat roller 2 and the pressure roller 3 of the fixing apparatus 1.

Referring to FIG. 20, the first coil 1011*a* incorporated in the hear roller 2 is connected to the capacitor 32 of the excitation circuit 31 in series, and the second coil 1011*b* incorporated in the pressure roller 3 is connected to the same capacitor 33 in series.

Based on this, the power with the first resonance frequency $f_1$ indicated by the curve $P_1$ described in conjunction with FIG. 13 is used to increase the temperature of the heat roller 2. In addition, the power with the second resonance frequency $f_2$ indicated by the curve $P_2$ is utilized to increase the temperature of the pressure roller 3. It is to be noted that the third frequency $f_{12}$ capable of causing the both coils 1011*a* and 1011*b* to produce predetermined magnetic fluxes is supplied to the both coils like the above example.

In such a system, by simultaneously increasing the temperatures (heating) of the heat roller 2 and the pressure roller 3 by using the above-described third resonance frequency $f_{12}$, the temperature of each roller can be maintained at a temperature which can restore the temperature enabling the image formation with a small energization time while reducing the power consumption in, e.g., the standby state.

As described above, in the fixing apparatus utilizing the induction heating mode according to the present invention, since increasing the frequency of the drive output applied to each coil can reduce the cross section of the wire used for the coil, thereby utilizing the heat roller with the small outside diameter.

Additionally, by arranging a plurality of the coils in the axial direction of the hear roller and selectively supplying the power with a predetermined frequency to each coil, the drive circuit and the switching circuit can be integrated as one.

As described above, according to the present invention, in the induction heating type fixing apparatus utilizing the electromagnetic induction, the size of the fixing apparatus can be also reduced while suppressing the intensity of the current flowing through the coils.

Further, the temperature increasing time required to increase the temperature of the heating target to a predetermined temperature is also reduced. As a result, the temperature increasing capability can be improved without increasing the power consumption.

Therefore, it is possible to obtain the image forming apparatus with the short warm-up time.

Furthermore, according to the fixing apparatus according to the present invention, it is possible to prevent the flicker from being generated in the illumination in the commercial power supply circuit in which the fixing apparatus and the copying apparatus are incorporated.

The present invention is not limited to the embodiments described above and can be modified in various manners without departing from the spirit and scope of the invention.

For example, the present invention can provide a fixing apparatus comprising: a cylindrical or belt-shaped heating target member formed of a material in which an induction current is generated by electromagnetic induction; a pressurization member which is arranged so as to be capable of providing a predetermined pressure to the heating target member and provides a predetermined pressure to a medium passed between itself and the heating target member; a first coil body which can be resonant with a power having a predetermined frequency and output a maximum output and to which a power having an arbitrary frequency used to generate the induction current to the heating target member is supplied; a second coil body which can be resonant with a power having a predetermined frequency, output a maximum power and is arranged in a predetermined positional relationship with respect to each of the first coil body and the heating target member and to which a power having an arbitrary frequency used to generate the induction current to the heating target member is supplied; a first temperature detection mechanism which is provided in the vicinity of a first position at which the heating target member generates the heat by the induction current from the first coil body and detects a temperature at the first position of the heating target member; a second temperature detection mechanism which is provided in the vicinity of a second position at which the heating target member generates the heat by the induction current from the second coil body and detects a temperature at the second position of the heating target member; a temperature difference detection mechanism which compares the temperature at the first position of the heating target member detected by the first temperature detection mechanism with the temperature at the second position of the heating target member detected by the second temperature detection mechanism and outputs a temperature difference between them; a drive control mechanism which switches a timing of supply of the power having a predetermined frequency to each of the first coil body and the second coil body in such a manner that a value of the temperature difference outputted from the temperature difference detection mechanism becomes a predetermined value; and a drive circuit which can supply a drive output having any of the first frequency, the second frequency and a third frequency different from the first and second frequencies to at least either the first coil body or the second coil body.

The present invention can also provide a fixing apparatus comprising: a cylindrical or belt-shaped heating target member formed of a material in which an induction current is generated by electromagnetic induction; a pressurization member which is arranged so as to be capable of providing a predetermined pressure to the heating target member and provides a predetermined pressure to a medium passed between itself and the heating target member; a first coil body which can be resonant with a power having a predetermined frequency and output a maximum output and to which a power having an arbitrary frequency used to generate the induction current to the heating target member is supplied; a second coil body which can be resonant with a power having a predetermined frequency, output a maximum power and is arranged in a predetermined positional relationship with respect to each of the first coil body and the heating target member and to which a power having an arbitrary frequency used to generate the induction current to the heating target member is supplied; a first temperature detection mechanism which is provided in the vicinity of a first position at which the heating target member generates the heat by the induction current from the first coil body and detects a temperature at the first position of the heating target member; a second temperature detection mechanism which is provided in the vicinity of a second position at which the heating target member generates the heat by the induction current from the second coil body and detects a temperature at the second position of the heating target member; a temperature difference detection mechanism which compares the temperature at the first position of the heating target member detected by the first temperature detection mechanism with the temperature at the second position of the heating target member detected by the second temperature detection mechanism and outputs a temperature difference between them; a drive control mechanism which switches a timing of supply of the power having a predetermined frequency to each of the first coil body and the second coil body in such a manner that a value of the temperature difference outputted from the temperature difference detection mechanism becomes a predetermined value; and a drive circuit which can supply a drive output having any of the first frequency, the second frequency and a third frequency different from the first and second frequencies to at least either the first coil body or the second coil body, wherein the second coil body is divided along an axial line so as to enable a peripheral surface of the heating target member to move at a predetermined speed when the heating target member has a cylindrical shape and a belt surface of the heating target member to move at a predetermined speed when the heating target member has a belt-like shape, and the second coil body is positioned in such a manner that the first coil body can be arranged between the divided second coil bodies.

The present invention can further provide a temperature increasing apparatus comprising: a cylindrical or belt-shaped heating target member formed of a material in which an induction current is generated by electromagnetic induction; a pressurization member which is arranged so as to be capable of providing a predetermined pressure to the heating target member and provides a predetermined pressure to a medium passed between itself and the heating target member; a first coil body which can be resonant with a power having a predetermined frequency and output a maximum output and to which a power having an arbitrary frequency used to generate the induction current to the heating target member is supplied; a second coil body which can be resonant with a power having a predetermined frequency, output a maximum power and is arranged in a predetermined positional relationship with respect to each of the first coil body and the heating target member and to which a power having an arbitrary frequency used to generate the induction current to the heating target member is supplied; a first temperature detection mechanism which is provided in the vicinity of a first position at which the heating target member generates the heat by the induction current from the first coil body and detects a temperature at the first position of the heating target member; a second temperature detection mechanism which is provided in the vicinity of a second position at which the heating target member generates the heat by the induction current from the second coil body and detects a temperature at the second position of the heating target member; a temperature difference detection mechanism which compares the temperature at the first position of the heating target member detected by the first temperature detection mechanism with the temperature at the second position of the heating target member detected by the second temperature detection mechanism and outputs a temperature difference between them; a drive control mechanism which switches a timing of supply of the power having a predetermined frequency to each of the first coil body and the second coil body in such a manner that a value of the temperature difference outputted from the temperature difference detection mechanism becomes a predetermined value; and a drive circuit which can supply a drive output having any of the first frequency, the second frequency and a third frequency different from the first and second frequencies to at least either the first coil body or the second coil body, wherein a temperature increasing method is characterized in that the drive circuit which can supply the drive output having any of the first frequency, the second frequency and the third frequency different from the first and second frequencies to at least either the first coil body or the second coil body is used to supply a drive output having any of the first frequency, the second frequency and the third frequency which is different from the first and second frequencies to at least either the first coil body and the second coil body in accordance with a difference between the temperature at the first position and the temperature at the second position detected by the temperature difference detection mechanism.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A fixing apparatus comprising:

a heat-producing member which has a hollow cylindrical shape or an endless belt-like shape, is formed in such a manner that a peripheral surface thereof can move at a predetermined speed if it has the cylindrical shape and a belt surface thereof can move at a predetermined speed if it has the belt-like shape, and can supply a predetermined heat to a material having a thermofusion property and a base material holding the material having the thermofusion property;

a pressure provision mechanism which is arranged so as to be capable of providing a predetermined pressure to the heat-producing member with the material having the thermofusion property and the base material being interposed between itself and the heat-producing member, and can move in accordance with the peripheral surface and the belt surface of the heat-producing member when the peripheral surface and the belt surface of the heat-producing member are moved at a predetermined speed;

a heating mechanism which is arranged in a predetermined positional relationship with respect to the heat-producing member and arranged in such a manner that at least two coil members to which different resonance frequencies are given have a predetermined positional relationship in a direction orthogonal to a direction along which the peripheral surface and the belt surface of the heat-producing member are moved, and can generate a predetermined power or a magnetic flux required to cause the heat-producing member to output a predetermined quantity of heat when a current having a first frequency, a second frequency or a third frequency which is different from the first and second frequencies is supplied;

a temperature detection mechanism which detects a temperature at a predetermined position of the heat-producing member; and a setting mechanism which sets a frequency of the power of the magnetic flux outputted from the heating mechanism to any of the first to third frequencies based on the temperature at the predetermined position of the heat-producing member detected by the temperature detection mechanism.

2. The fixing apparatus according to claim 1, wherein an arbitrary number of the temperature detection mechanisms are arranged at a position where a temperature of the heat-producing member is increased by the coil members having the different resonance frequencies given thereto or in the vicinity of that position in units of supply of a predetermined power to the coil members, and can detect the temperature of the heat-producing member in the same units.

3. The fixing apparatus according to claim 2, further comprising a drive circuit which can supply a drive output having a predetermined frequency to the heating mechanism, the drive circuit being capable of outputting the drive outputs having the first to third frequencies.

4. The fixing apparatus according to claim 3, wherein the third frequency outputted from the drive circuit is a frequency different from any resonance frequency given to each of the coil members, and corresponds to a drive output on a predetermined level with respect to each of the coil members.

5. The fixing apparatus according to claim 2, further comprising:

a temperature difference detection mechanism which compares a temperature of the heat-producing member detected by at least one of the temperature detection mechanisms with a temperature of the heat-producing member detected by a temperature detection mechanism different from the former temperature detection mechanism, an arbitrary number of the temperature difference detection mechanisms being arranged at positions where the temperature of the heat-producing member is increased by the coil members to which the different resonance frequencies to output a temperature difference are given or in the vicinity of such positions in units of supply of a predetermined power to the coil members, the temperature difference detection mechanism being capable of detecting a temperature of the heat-producing member in the same units; and a drive control mechanism which switches the frequency of the predetermined power supplied to each of the coil members from the drive circuit in such a manner that a value of the temperature difference outputted from the temperature difference detection mechanism becomes a predetermined value, wherein the frequency of the predetermined power that the drive circuit should output is changed by the drive control mechanism based on the temperature difference detected by the temperature difference detection mechanism.

6. The fixing apparatus according to claim 5, further comprising a temperature difference condition change mechanism which can change a value of the temperature difference outputted from the temperature difference based on a predetermined condition.

7. The fixing apparatus according to claim 5, further comprising a temperature difference detection condition change mechanism which can change a detection timing to detect temperature information of the heat-producing member outputted from the temperature detection mechanism.

8. The fixing apparatus according to claim 5, further comprising a drive switching condition change mechanism which can arbitrarily set a timing that the drive control mechanism switches supply of a predetermined power to each of the coil members based on a value of the temperature difference outputted from the temperature difference detection mechanism.

9. The fixing apparatus according to claim 5, where in a temperature difference of the heat-producing member dependent on a position of each of the coil members is recognized based on the temperature information of an arbitrary position of the heat-producing member outputted from the temperature detection mechanism, supply of the power having the resonance frequency of the coil member which generates the induction current at a position with a higher temperature in the heat-producing member is stopped, and the power having the resonance frequency of the coil member which generates the induction current at a position with a lower temperature is supplied, and a temperature difference of the heat-producing member dependent on the position of each of the coils is recognized from the temperature information outputted from the temperature detection mechanism, and the power having the resonance frequency of any coil member which generates the induction current at the position with the lower temperature is supplied to the corresponding coil member.

10. The fixing apparatus according to claim 1, further comprising a drive circuit which can supply a drive output having a predetermined frequency to the heating mechanism, the drive circuit being capable of outputting the drive outputs having the first to third frequencies.

11. The fixing apparatus according to claim 10, wherein the third frequency outputted from the drive circuit is a frequency different from any resonance frequency given to each of the coil members, and corresponds to a drive output on a predetermined level with respect to each of the coil members.

* * * * *